US009610769B2

(12) United States Patent
Kubota

(10) Patent No.: US 9,610,769 B2
(45) Date of Patent: Apr. 4, 2017

(54) LIQUID INJECTION HEAD, METHOD OF MANUFACTURING LIQUID INJECTION HEAD, AND LIQUID INJECTION DEVICE

(71) Applicant: SII PRINTEK INC., Chiba-shi, Chiba (JP)

(72) Inventor: Yuzuru Kubota, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 15/085,767

(22) Filed: Mar. 30, 2016

(65) Prior Publication Data

US 2016/0318302 A1 Nov. 3, 2016

(30) Foreign Application Priority Data

Apr. 28, 2015 (JP) ..... 2015-091091

(51) Int. Cl.
*B41J 2/14* (2006.01)
*B41J 2/16* (2006.01)

(52) U.S. Cl.
CPC ..... *B41J 2/14209* (2013.01); *B41J 2/14201* (2013.01); *B41J 2/162* (2013.01); *B41J 2/1606* (2013.01); *B41J 2/1609* (2013.01); *B41J 2002/14217* (2013.01); *B41J 2002/14491* (2013.01)

(58) Field of Classification Search
None
See application file for complete search history.

(56) References Cited

U.S. PATENT DOCUMENTS 8,596,757 B2 * 12/2013 Koseki ..... B41J 2/14209 347/44

FOREIGN PATENT DOCUMENTS

JP 2000168094 6/2000

* cited by examiner

*Primary Examiner* — Lisa M Solomon
(74) *Attorney, Agent, or Firm* — Adams & Wilks

(57) ABSTRACT

An individual electrode formed on an inside surface of a dummy channel, a common electrode formed on an inside surface of a discharge channel, an individual pad formed in a connection groove of an actuator plate, connecting the individual electrodes opposed in an X direction across the discharge channel, and to which an FPC is connected, a shallow groove portion opened toward a rear side on the actuator plate, a common pad formed in the shallow groove portion, and connecting the common electrode and the FPC through the shallow groove portion, and a dividing groove formed in a corner portion made by a surface and a rear-side end surface of the actuator plate, and dividing the common pad from the individual pad.

11 Claims, 21 Drawing Sheets

LIQUID INJECTION HEAD, METHOD OF MANUFACTURING LIQUID INJECTION HEAD, AND LIQUID INJECTION DEVICE

BACKGROUND

Technical Field

The present invention relates to a liquid injection head, a method of manufacturing a liquid injection head, and a liquid injection device.

Related Art

Conventionally, as a device that discharges a droplet ink to a recording medium such as a recording paper, and recording images and texts on the recording medium, there is an inkjet printer (liquid injection device) including an inkjet head (liquid injection head).

A head chip of the inkjet head includes an actuator plate in which discharge channels and dummy channels are alternately arranged in parallel in a surface side, and a cover plate laminated on the actuator plate, and including a common ink chambers collectively communicating into the discharge channels. Further, a common electrode serving as a reference potential GND is formed on an inner surface of the discharge channel, and an individual electrode serving as a drive potential Vdd is formed on an inner surface of the dummy channel, of the channels.

For example, in JP 2000-168094 A, individual wiring passes through one end surface in the actuator plate in an extending direction of the channels, and is connected to an individual pad formed on a back surface of the actuator plate. Meanwhile, common wiring passes through the other end surface in the actuator plate in the extending direction of the channels, and is connected to a common pad formed on the back surface in the actuator plate. The pads are divided with a dividing groove on the back surface, and are connected to external wiring such as a flexible printed circuit board bonded to the back surface.

SUMMARY

However, in the configuration of JP 2000-168094 A, the individual wiring and the common wiring are pulled up to the pads on the back surface through both end surfaces of the actuator plate in the extending direction of the channels. Therefore, there is a problem that a wiring pattern becomes complicated.

Further, recently, as a configuration to achieve multi nozzles of a high-density recording of texts and images to be recorded on the recording medium, a configuration to laminate a plurality of head chips along a thickness direction of the actuator plate is known. However, the configuration described in JP 2000-168094 A is difficult to achieve the multi nozzles after achieving downsizing because the wiring is connected to external wiring on the back surface of the actuator plate.

The present invention has been made in view of the foregoing, and an objective is to provide a liquid injection head, a method of manufacturing a liquid injection head, and a liquid injection device that can realize multi nozzles after achieving simplification of a wiring pattern and downsizing.

The present invention provides following units to solve the above problems.

A liquid injection head according to the present invention includes: an actuator plate; injection channels arranged in an extending manner along a first direction and arranged in parallel to a second direction intersecting with the first direction with a space in a surface of the actuator plate, and having one end portions in the first direction terminated in the actuator plate; dummy channels arranged in an extending manner along the first direction and alternately arranged in parallel to the injection channels in the second direction in the surface of the actuator plate, and opened in one end surface of the actuate plate in the first direction; an individual electrode formed on an inside surface of the dummy channel; a common electrode formed on an inside surface of the injection channel; an individual pad formed on a connection surface facing one end side in the first direction in a portion positioned between the adjacent dummy channels, the portion being of the actuator plate, individually connecting the individual electrodes opposed in the second direction across the injection channel, and to which individual-side external wiring is connected; a recessed portion formed in a position between the adjacent dummy channels, and opened toward the one end side in the first direction, in the surface of the actuator plate; a common pad formed in an inner surface of the recessed portion, and connecting the common electrode and common-side external wiring through the recessed portion; and a dividing portion formed in a corner portion made by the surface and the one end surface, of the actuator plate, and dividing the common pad from the individual pad.

According to this configuration, the common-side external wiring and the individual-side external wiring are respectively connected to the common pad formed in the recessed portion and the individual pad formed on the connection surface. Therefore, the actuator plate (the common pad and the individual pad), and the individual-side external wiring and the common-side external wiring can be connected from one end side in the first direction in the actuator plate. Accordingly, the wiring pattern can be simplified compared with the conventional configuration to pull the individual electrode and the common electrode to the individual pad and the common pad formed on the back surface of the actuator plate.

Further, by forming the common pad in the recessed portion, a contact area of the common-side external wiring and the common pad can be secured compared with a case of connecting the common pad formed on the surface of the actuator plate to the common-side external wiring from the one end side in the first direction. Accordingly, electrical reliability can be secured.

Then, the connection of the common pad and the individual pad, and the individual-side external wiring and the common-side external wiring is performed for the actuator plate from the one end side in the first direction. Therefore, the actuator plates can be easily laminated in a thickness direction. In this case, the multi nozzles can be achieved after downsizing is achieved compared with a case of achieving the multi nozzles using a plurality of inkjet heads.

In the liquid injection head according to the present invention, a connection groove opened toward the one end side in the first direction in the actuator plate, and depressed to the other end side in the first direction in the one end surface may be formed, in the portion positioned between the adjacent dummy channels, the portion being of the actuator plate, and a surface facing the one end side in the first direction, the surface being of an inner surface of the connection groove, may configure the connection surface.

According to this configuration, the surface facing the one end side in the first direction, of the inner surface of the connection groove, configures the connection surface. Therefore, the individual pad is arranged in a position depressed from the one end surface of the actuator plate by one step. Accordingly, interference between the individual pad and a peripheral member is suppressed, and the individual pad can be protected.

In the liquid injection head according to the present invention, a groove depth of the dummy channel may be deeper than a groove depth of the connection groove.

According to this configuration, the groove depth of the dummy channel is deeper than the groove depth of the connection groove. Therefore, for example, when the individual pad is formed on the connection surface by oblique deposition, the electrode material less easily adheres to a bottom surface of the dummy channel. As a result, it is not necessary to perform a removing process of removing the electrode material adhering to the bottom surface of the dummy channel, after the electrode forming process. Therefore, manufacturing efficiency can be improved.

In the liquid injection head according to the present invention, a bump accommodated in the recessed portion and to be connected to the common pad in the recessed portion may be formed in the common-side external wiring.

According to this configuration, electrical reliability between the common-side external wiring and the common pad can be easily secured.

The method of manufacturing the liquid injection head according to the present invention may include: a recessed portion forming process of forming the recessed portion opened toward the one end side in the first direction in the portion positioned between the adjacent dummy channels, in the surface of the actuator plate, in a preceding step of the electrode forming process.

According to this configuration, by forming the recessed portion in a preceding part of the electrode forming process, the electrode material that is to serve as the common pad can be formed on the inner surface of the recessed portion at the same time with inside surfaces of the channels in the electrode forming process. Then, the common pad can be formed in the recessed portion. Therefore, for example, the contact area of the common-side external wiring and the common pad can be secured compared with a case of connecting the common pad formed on the surface of the actuator plate to the common-side external wiring from the one end side in the first direction. Accordingly, the electrical reliability can be secured.

The method of manufacturing the liquid injection head according to the present invention may include: a crossing groove forming process of forming a crossing groove extending along the second direction and intersecting with the dummy channel, in a portion positioned between the actuator plate, of a surface of a wafer to which the actuator plates continue in the first direction, in a preceding step of the electrode forming process; and an individualizing process of cutting a portion positioned between the crossing grooves and individualizing the portion for each of the actuator plates, of the wafer, in a subsequent step of the electrode forming process.

According to this configuration, wafer-level work can be performed. Therefore, the manufacturing efficiency can be improved. Further, the crossing groove is formed in a preceding part of the electrode forming process, so that the electrode material can be formed on an inner surface of the crossing groove at the same time as the inside surfaces of the channels in the electrode forming process. Then, by individualizing the wafer at the crossing groove, the actuator plates in which the individual pad is formed on the connection surface (connection groove) facing the one end side in the first direction can be taken out. In this case, the manufacturing efficiency can be further improved compared with a case of separately forming the individual pad after the individualization.

The method of manufacturing the liquid injection head according to the present invention may include: a crossing groove forming process of forming two crossing grooves extending along the second direction and intersecting with the dummy channel, in the first direction with a space, in a portion positioned between the actuator plates, of a surface of a wafer in which the actuator plates continue in the first direction, in a preceding step of the electrode forming process; and an individualizing process of cutting the wafer to remove a partition positioned between the two crossing grooves, of the wafer, and individualizing the wafer for each of the actuator plates, in a subsequent step of the electrode forming process.

According to this configuration, wafer-level work can be performed. Therefore, the manufacturing efficiency can be improved. Further, by forming the crossing groove in a preceding part of the electrode forming process, the electrode material can be formed on an inner surface of the crossing groove at the same time as the inside surfaces of the channels in the electrode forming process. Then, by cutting the wafer at the crossing groove, the actuator plates in which the individual pad is formed on the connection surface (connection groove) facing the one end side in the first direction can be taken out. In this case, the manufacturing efficiency can be further improved compared with a case of separately forming the individual pad after the individualization.

Furthermore, the groove widths of the crossing grooves can be narrowed compared with a configuration to separate the wafer at one crossing groove. Therefore, variation of the deposition depth due to the groove width or the groove depth of the crossing groove can be suppressed when the electrode material is formed in the crossing groove by oblique deposition in the electrode forming process.

In the method of manufacturing the liquid injection head according to the present invention, in the electrode forming process, oblique deposition may be performed for the surface of the actuator plate from a direction intersecting with the first direction and the second direction, in plan view as the actuator plate is viewed from a thickness direction.

According to this configuration, the oblique deposition is performed for the surface of the wafer from the direction intersecting with the first direction and the second direction. Therefore, the electrode material can be more easily deposited on the corner portion made by the dummy channel and the crossing groove than a case of performing the oblique deposition along the first direction or the second direction. Therefore, the electrical reliability between the individual electrode and the individual pad can be secured.

In the method of manufacturing the liquid injection head according to the present invention, in the channel forming process and in the crossing groove forming process, groove widths and groove depths of the dummy channel and the crossing groove may be set not to allow the electrode material to be deposited on a bottom surface of the dummy channel in the electrode forming process.

According to this configuration, it is not necessary to perform a removing processing of removing the electrode material adhering to the bottom surface of the dummy channel after the electrode forming process. Therefore, the manufacturing efficiency can be improved.

A liquid injection device according to the present invention includes: the liquid injection head according to the present invention; and a moving mechanism configured to relatively move the liquid injection head and a recording medium.

According to this configuration, the liquid injection head according to the present invention is included. Therefore, the multi nozzles can be realized after simplification and downsizing are achieved.

According to the present invention, multi nozzles can be realized after simplification of a wiring pattern and downsizing are achieved.

DETAILED DESCRIPTION

Figure 1:
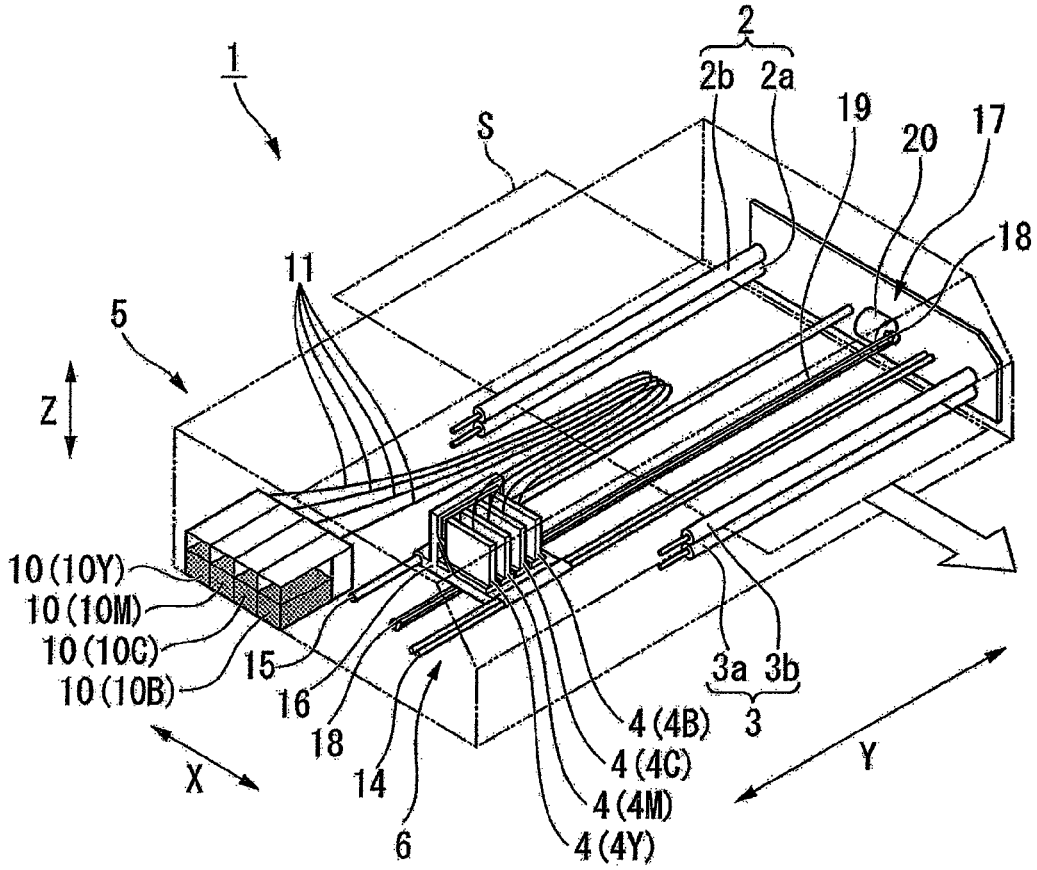
FIG. 1 is a schematic configuration diagram of an inkjet printer.

Hereinafter, embodiments according to the present invention will be described with reference to the drawings. In the embodiments below, as an example of a liquid injection device including a liquid injection head of the present invention, an inkjet printer (hereinafter, simply referred to as printer) that performs recording on a recording medium using an ink (liquid) will be exemplarily described. In the drawings to be used in the description below, scales of respective members are appropriately changed so that the respective members have recognizable sizes.

[Printer]

FIG. 1 is a schematic configuration diagram of a printer 1.

As illustrated in FIG. 1, the printer 1 includes a pair of conveying mechanisms 2 and 3 that conveys a recording medium S such as a paper, inkjet heads (liquid injection heads) 4 that inject ink droplets on the recording medium S, an ink supply unit 5 that supplies inks to the inkjet heads 4, and a scanning unit 6 that causes the inkjet heads 4 in a direction (sub-scanning direction) perpendicular to a conveying direction (main-scanning direction) of the recording medium S. Note that the following description will be given base on a rule that the main-scanning direction is an X direction, the sub-scanning direction is a Y direction, and a direction perpendicular to the X direction and the Y direction is a Z direction.

The pair of conveying mechanisms 2 and 3 includes grid rollers 2*a* and 3*a* extending in the Y direction, pinch rollers 2*b* and 3*b* extending in parallel to the grid rollers 2*a* and 3*a*, and a drive mechanism (not illustrated) such as a motor that operates and rotates the grid rollers 2*a* and 3*a* to perform a rotary operation around its axes.

The ink supply unit 5 includes ink tanks 10 that accommodate inks, and ink piping 11 that connects the ink tanks 10 and the inkjet heads 4. The ink tank 10 includes ink tanks 10Y, 10M, 10C, and 10B that accommodate four types of inks including yellow, magenta, cyan, and black, for example. The ink piping 11 is a flexible hose having flexibility, and can follow an operation (movement) of a carriage 16 that supports the inkjet heads 4. Note that the ink tanks 10 are not limited to the ink tanks 10Y, 10M, 10C, and 10B that accommodate four types of inks including yellow, magenta, cyan, and black. The ink tanks 10 may include ink tanks that further accommodate many colors of inks, or the ink tank 10 may include a single ink tank.

The scanning unit 6 includes a pair of guide rails 14 and 15 extending in the Y direction, and arranged in parallel to each other with a space in the X direction, the carriage 16 arranged to be movable along the pair of guide rails 14 and 15, and a drive mechanism 17 that moves the carriage 16 in the Y direction.

The drive mechanism 17 includes a pair of pulleys 18 arranged between the pair of guide rails 14 and 15, and arranged with a space in the Y direction, an endless belt 19 that is wound between the pair of pulleys 18 and travels in the Y direction, and a drive motor 20 that drives and rotates one of the pulleys 18.

The carriage 16 is connected to the endless belt 19, and is movable in the Y direction in association with movement of the endless belt 19 by the rotary drive by one of the pulleys 18. Further, the plurality of inkjet heads 4 is mounted on the carriage 16 in an aligned state in the Y direction. In the illustrated example, the four inkjet heads 4 (that is, the inkjet heads 4Y, 4M, 4C, and 4B) that respectively discharge the inks of yellow, magenta, cyan, and black are mounted on the carriage 16. Note that the conveying mechanism 2 and 3 and the scanning unit 6 configure a moving mechanism that relatively moves the inkjet heads 4 and the recording medium S.

(Inkjet Head)

Figure 2:
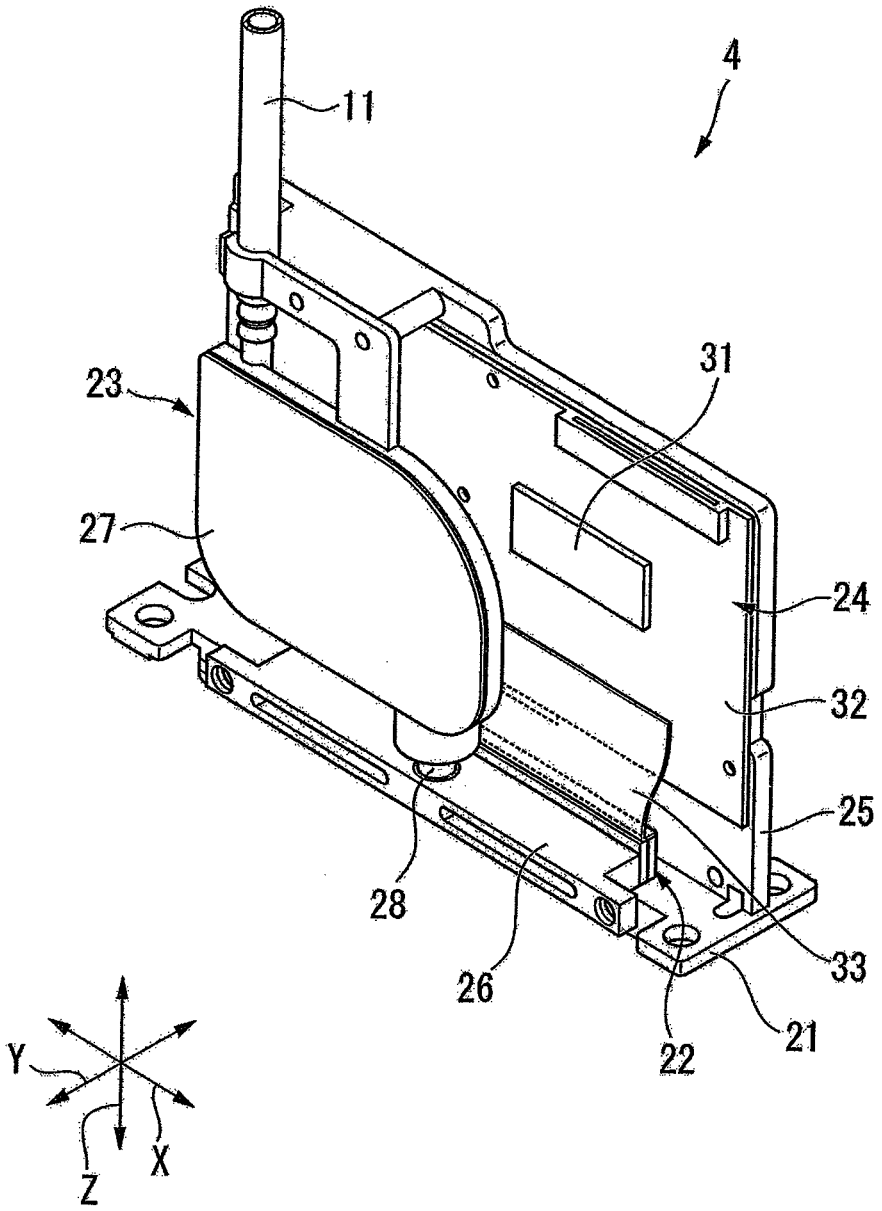
FIG. 2 is a perspective view of an inkjet head.

Next, the above-described inkjet head 4 will be described. FIG. 2 is a perspective view of the inkjet head 4. Note that the above-described inkjet heads 4 are made of the same configuration except the colors of the inks to be supplied. Therefore, in the description below, one inkjet head 4 will be described.

As illustrated in FIG. 2, the inkjet head 4 includes a fixing plate 21 fixed to the carriage 16, a discharge unit 22 fixed on the fixing plate 21, an ink supply unit 23 that further supplies the ink supplied from the ink supply unit 5 to a common ink chamber 71 described below of the discharge unit 22, and a head drive unit 24 that applies a drive voltage to the discharge unit 22.

The inkjet head 4 discharges the ink of each color with a predetermined discharge amount by being applied the drive voltage. At this time, the inkjet head 4 is moved in the Y direction by the scanning unit 6, so that printing can be performed in a predetermined range on the recording medium S. Further, the above-described scanning is repeatedly performed while the recording medium S is conveyed in the X direction by the conveying mechanisms 2 and 3, so that the printing can be performed on the entire recording medium S.

A support plate 25 made of metal such as aluminum is fixed to the fixing plate 21 in a rising state along the Z direction, and a passage member 26 that supplies the ink to the discharge unit 22 is fixed. A pressure damper 27 having a storage chamber inside, the storage chamber storing the ink, is supported by the support plate 25. While the pressure damper 27 is connected to the ink tank 10 through the ink piping 11, and the pressure damper 27 is connected to the passage member 26 through the ink connecting pipe 28. In this case, when the ink is supplied through the ink piping 11, the pressure damper 27 stores the ink in the storage chamber inside once, and then supplies a predetermined amount of ink to the discharge unit 22 through the ink connecting pipe 28 and the passage member 26. Note that these passage member 26, pressure damper 27, and ink connecting pipe 28 configure the above-described ink supply unit 23.

Further, an IC substrate 32 on which a control circuit 31 such as an integrated circuit for driving the discharge unit 22 is mounted is attached to the support plate 25. This IC substrate 32 is electrically connected to the discharge unit 22 through a flexible printed circuit board 33 (hereinafter, referred to as FPC 33). Then, the IC substrate 32 on which the control circuit 31 is mounted and the FPC 33 configure the above-described head drive unit 24.

(Discharge Unit)

Figure 3:
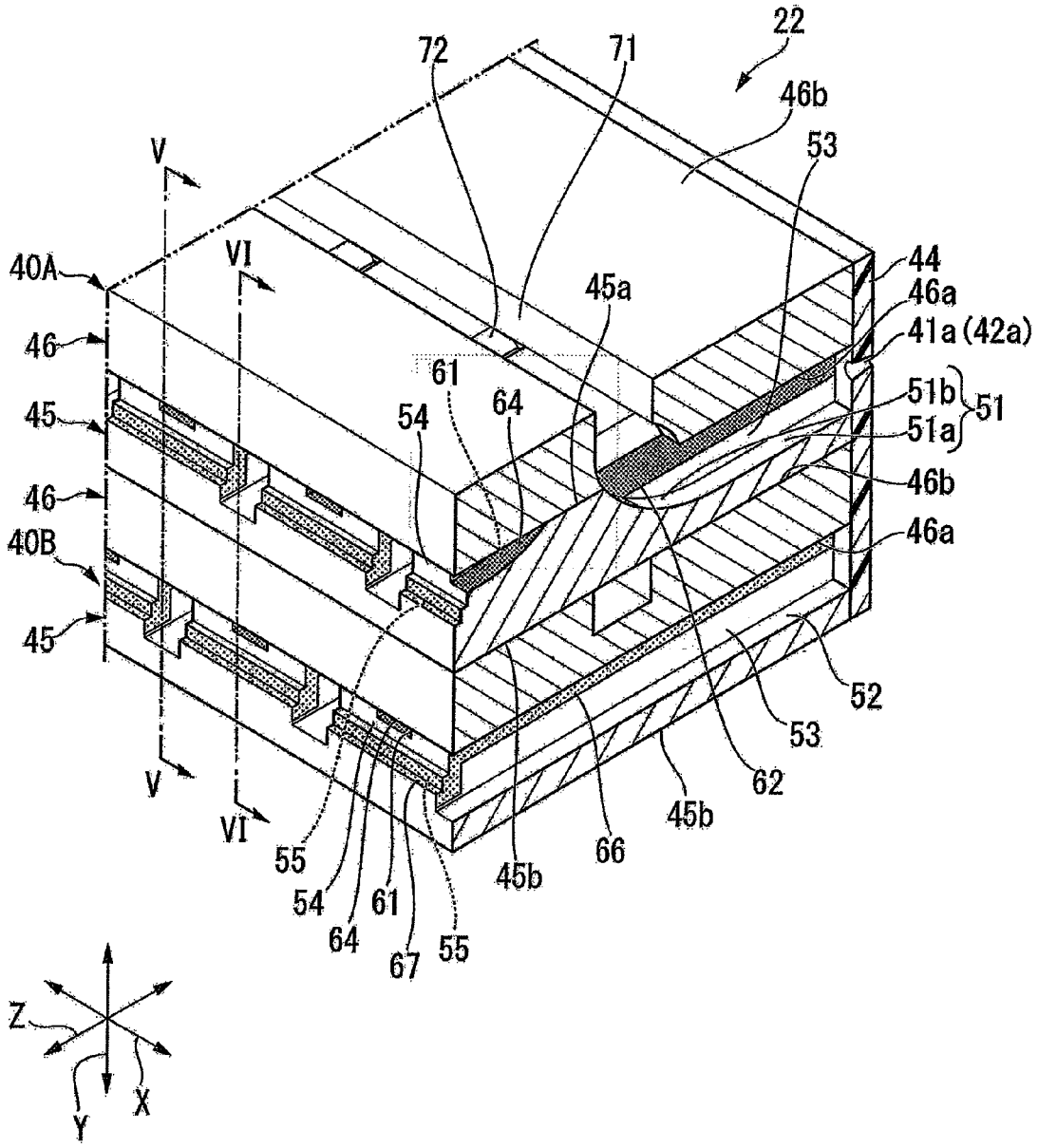
FIG. 3 is a perspective view of a discharge unit as viewed from one end side in a Z direction.
Figure 4:
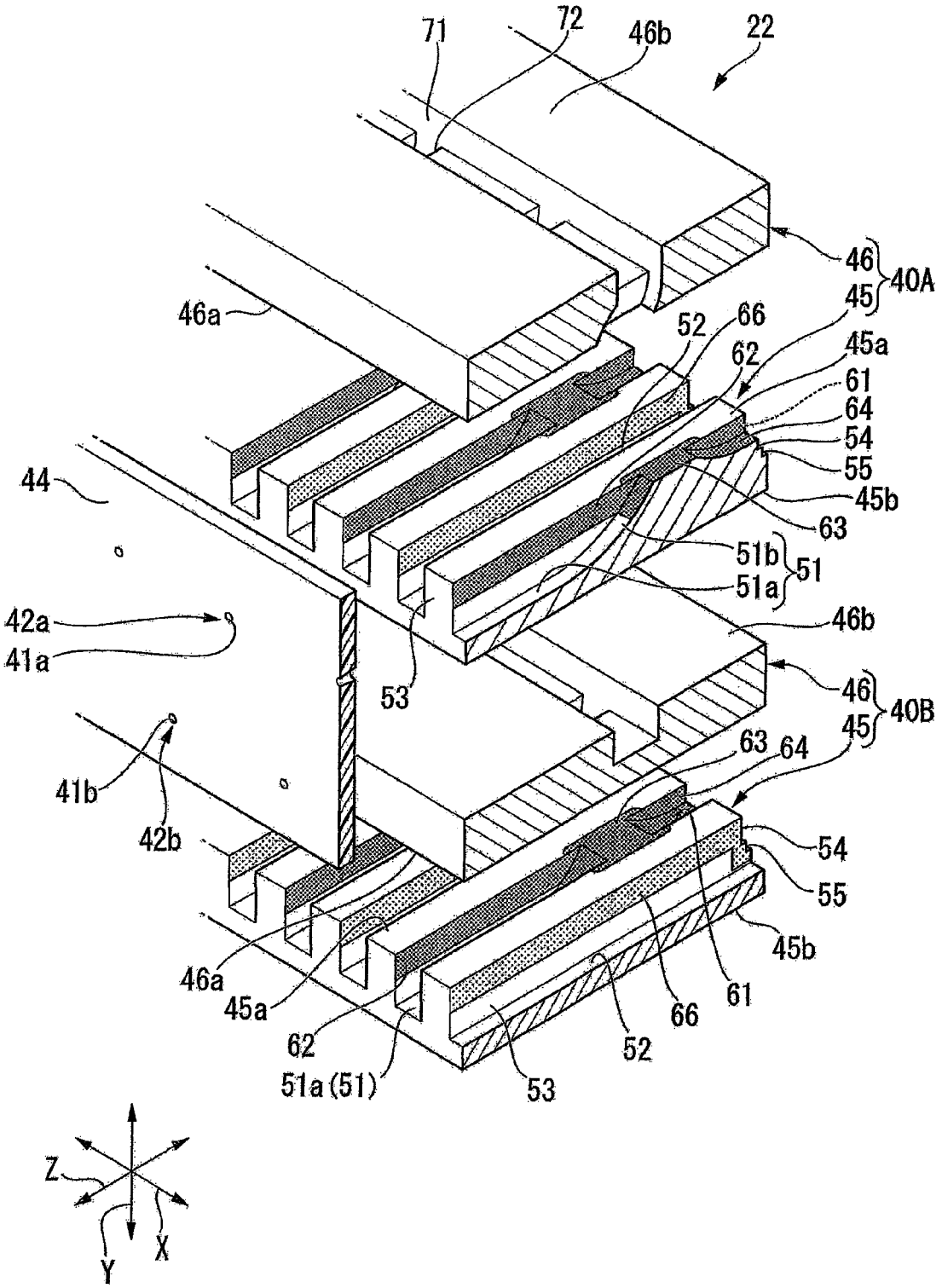
FIG. 4 is an exploded perspective view of the discharge unit as viewed from the other end side in the Z direction.
Figure 5:
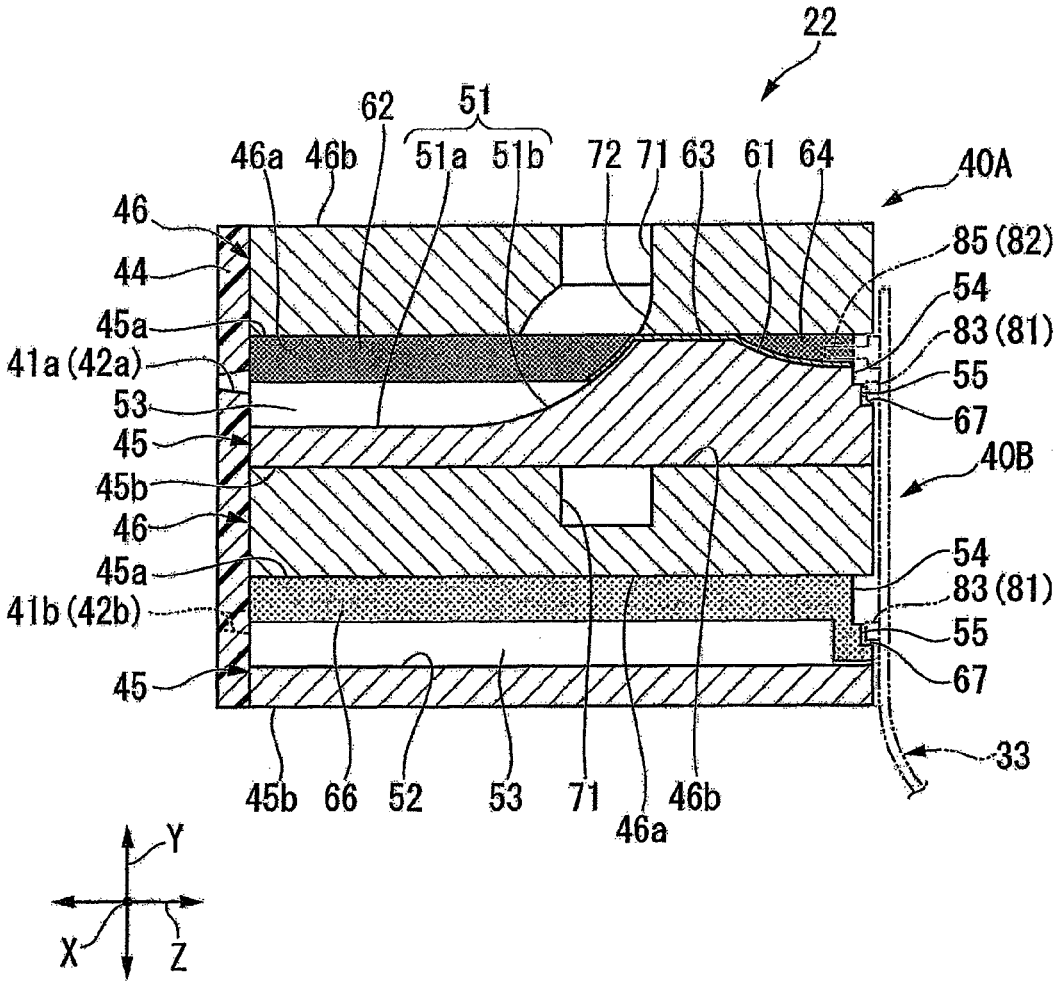
FIG. 5 is a sectional view corresponding to the V-V line of FIG. 3.
Figure 6:
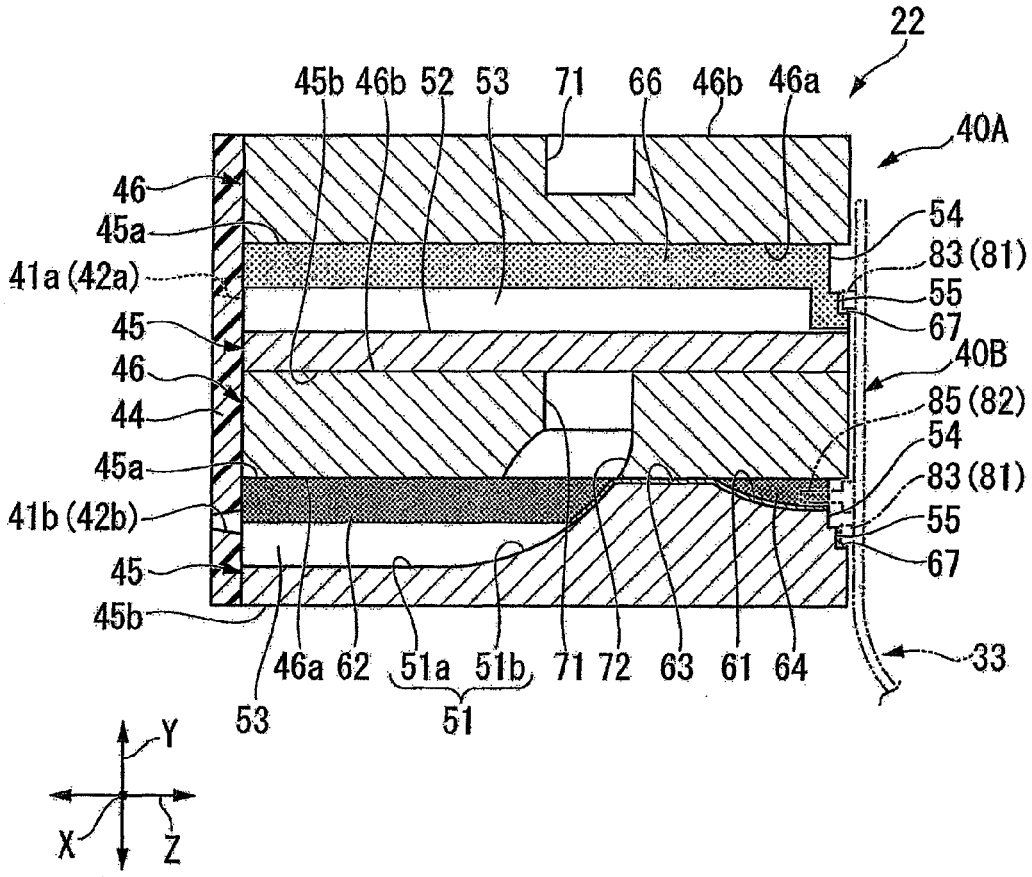
FIG. 6 is a sectional view corresponding to the VI-VI line of FIG. 3.

Next, the discharge unit 22 will be described in detail. FIG. 3 is a perspective view of the discharge unit 22 as viewed from one end side in the Z direction, and FIG. 4 is an exploded perspective view of the discharge unit 22 as viewed from the other end side in the Z direction. FIG. 5 is a sectional view along the V-V line of FIG. 3, and FIG. 6 is a sectional view along the VI-VI line of FIG. 3.

As illustrated in FIGS. 3 to 6, the discharge unit 22 of the present embodiment is a two-array type discharge unit 22 in which nozzle arrays 42*a* and 42*b* made of a plurality of nozzle holes (first nozzle holes 41*a* and second nozzle holes 41*b*) are formed in two arrays. To be specific, the discharge unit 22 includes a plurality of a first head chip 40A and a second head chip 40B laminated in the Y direction, and a nozzle plate 44 fixed to both of the first head chip 40A and the second head chip 40B. Note that the head chips 40A and 40B are so-called edge-shoot type head chips that discharge the ink through a discharge channel 51 described below. Further, in the description below, the first head chip 40A will be mainly described, and a portion in the second head chip 40B corresponding to the first head chip 40A is denoted with the same reference sign, and description is omitted. Note that, in the description below, the description will be given based on a rule that one end side (first head chip 40A side) in the Y direction is a surface side and the other end side (second head chip 40B side) is a back side, and one end side (opposite side to the nozzle plate 44) in the Z direction is a rear side and the other end side (nozzle plate 44 side) is a front side.

The first head chip 40A mainly includes an actuator plate 45 and a cover plate 46 laminated in the Y direction.

The actuator plate 45 is formed of a piezoelectric material such as lead zirconate titanate (PZT), and its polarizing direction is set to one direction along a thickness direction (Y direction). A plurality of channels 51 and 52 opened in a surface 45*a* is formed in the surface 45*a* in the actuator plate 45.

The channels 51 and 52 are linearly formed in the Z direction (first direction) and are formed in the X direction (second direction) at equal intervals, and are defined with drive walls 53 made of a piezoelectric body (actuator plate 45). To be specific, the plurality of channels 51 and 52 includes discharge channels (injection channels) 51 in which the ink is filled, and dummy channels 52 in which no ink is filled. Then, these discharge channels 51 and dummy channels 52 are alternately arrayed in the X direction.

As illustrated in FIGS. 4 and 5, the discharge channel 51 has a rear-side end portion terminated in the actuator plate 45, and a front-side end portion opened at a front-side end surface in the actuator plate 45. To be specific, the discharge channel 51 includes an extending portion 51*a* positioned in the front-side end portion, and having an equal groove depth, and a rising portion 51*b* provided in the rear-side end portion in the extending portion 51*a* in a linked manner, and having a groove depth that becomes shallower as going to the rear side.

The dummy channel 52 penetrates the actuator plate 45 in the Z direction, and having both end portions in the Z direction opened at both end surfaces in the actuator plate 45 in the Z direction. Note that, in the illustrated example, the dummy channel 52 has an equal groove depth throughout in the Z direction.

A portion positioned posterior to the discharge channel 51 (hereinafter, the portion is referred to as tail portion), of the actuator plate 45, is formed in a step-wise manner where the portion is lowered step by step toward the back side as going to the rear side. To be specific, in the actuator plate 45, a dividing groove (dividing portion) 54 depressed in the surface 45*a* to the back side by one step, and a connection groove (connection surface) 55 continuing to a rear-side end edge of the dividing groove 54, and further depressed from the dividing groove 54 to the back side are arranged.

The dividing groove 54 exhibits an L shape in side view as viewed from the X direction, and is formed to cut off a corner portion made by the surface 45*a* and a rear-side end surface (one end surface) of the actuator plate 45. In the dividing groove 54, its surface-side end edge continues from the rear side to the surface 45*a* of the actuator plate 45. Further, a rear-side end edge of a bottom surface in the dividing groove 54 continues from the front side to a surface-side end edge of the connection groove 55.

The connection groove 55 exhibits an L shape in a side view as viewed from the X direction, and is opened toward the surface 45*a* and the rear-side end surface of the actuator plate 45. The groove depth of the connection groove 55 (the length from the surface 45*a* of the actuator plate 45 to a bottom surface of the connection groove 55 in the Y direction) is shallower than the groove depth of the dummy channel 52. Therefore, the bottom surface of the connection groove 55 is positioned at a more surface side than a bottom surface of the dummy channel 52.

Shallow groove portions (recessed portions) 61 are individually formed in the surface 45*a* of the respective tail portions in the actuator plate 45. The shallow groove portion 61 has a front-side end portion terminated posterior to the discharge channel 51 in the actuator plate 45, and a rear-side end portion opened in the dividing groove 54. The shallow groove portion 61 has an equal groove width to the discharge channel 51 in plan view as viewed from the Y direction, and is arranged at an equal position to the corresponding discharge channel 51 in the X direction. Further, the front-side end portion of the shallow groove portion 61 exhibits an arc shape inside view as viewed from the X direction, and the groove depth is gradually deeper as going to the rear side. In the illustrated example, the maximum groove depth of the shallow groove portion 61 is shallower than the groove depths of the extending portion 51*a* of the discharge channel 51 and the dividing groove 54. Note that the groove depth, the groove width, and the like of the shallow groove portion 61 can be appropriately changed as long as the shallow groove portion 61 can accommodate a bump 85 of the FPC 33 described below.

Common electrodes 62 are formed on surfaces that define the discharge channels 51 (inner surfaces of the discharge channels 51), of the drive walls 53 of the actuator plate 45. The common electrode 62 has the width in the Y direction that is about one-half of the discharge channel 51, and is formed in a range from a surface-side end edge to an intermediate portion, on inside surfaces opposed in the X direction and a bottom surface of the rising portion 51*b*, of the inner surface of the discharge channel 51.

Common wiring 63 connected to the common electrode 62 is formed on the surface 45*a* of the tail portion in the actuator plate 45. The common wiring 63 has a belt-like shape extending along the Z direction, and its front-side end portion surrounds the rising portion 51*b* of the discharge channel 51, and the common wiring 63 is connected to the common electrode 62 in the discharge channel 51. A rear-side end portion of the common wiring 63 surrounds the front-side end portion of the shallow groove portion 61.

A common pad 64 is formed on an inner surface of the shallow groove portion 61. The common pad 64 connects the common wiring 63 and the FPC 33, and is formed on the entire inner surface of the shallow groove portion 61. A front-side end portion of the common pad 64 is connected to the common wiring 63 between the surface 45*a* of the actuator plate 45 and a surface-side end edge of the shallow groove portion 61. Meanwhile, a rear-side end edge of the common pad 64 accords with a rear-side end edge of the shallow groove portion 61.

As illustrated in FIGS. 4 and 6, individual electrodes 66 are individually formed on surfaces that define the dummy channels 52 (inner surfaces of the dummy channels 52), of the drive walls 53 of the actuator plate 45. Each of these individual electrodes 66 has the width in the Y direction that is about one-half of the dummy channel 52, and is formed in a range from a surface-side end edge to an intermediate portion, on inside surfaces opposed in the X direction, of the inner surface of the dummy channel 52. In this case, the individual electrodes 66 opposed in the same dummy channel 52, of the individual electrodes 66, are electrically separated. Note that, in the illustrated example, the individual electrode 66 is formed up to a portion positioned closer to a bottom surface side than an intermediate portion in the inside surface in the Y direction, in a rear-side end portion of the dummy channel 52.

As illustrated in FIGS. 3 and 5, an individual pad 67 that connects the individual electrodes 66 opposed in the X direction across the discharge channel 51, and to which the FPC 33 is connected is formed in the connection groove 55 of the actuator plate 45. The individual pad 67 is formed on the entire inner surface of the connection groove 55. One end portion (the right side in FIG. 3) of the individual pad 67 in the X direction is connected to the individual electrode 66 formed on the other end side (the left side in FIG. 3) in the X direction, in the dummy channel 52 positioned on the right side of the discharge channel 51 in the X direction. Meanwhile, a left-side end portion of the individual pad 67 is connected to the individual electrode 66 formed on the right side, in the dummy channel 52 positioned on the left side of the discharge channel 51.

Here, an electrode material is not formed on an inner surface of the dividing groove 54, and the dividing groove 54 divides the common pad 64 from the individual electrode 66 and the individual pad 67. Dimensions of the dividing groove 54 (the groove depth, the width in the Z direction, and the like) can be appropriately changed as long as the dividing groove 54 divides the common pad 64 from the individual electrode 66 and the individual pad 67, and does not divide the individual electrode 66 from the individual pad 67. In the illustrated example, the groove depth of the dividing groove 54 (from the surface 45*a* of the actuator plate 45 to the bottom surface of the dividing groove 54 in the Y direction) is shallower than the groove depth of the connection groove 55, and is about one-half of the groove depth of the dummy channel 52.

As illustrated in FIGS. 3 to 6, the cover plate 46 has a plate-like shape with an external shape in plan view as viewed from the Y direction, which is equal to the external shape of the actuator plate 45. Its back surface 46*a* is glued on the surface 45*a* of the actuator plate 45 and blocks the channels 51 and 52.

The cover plate 46 includes a common ink chamber 71 formed at a surface 46*b* side, and a plurality of slits 72 formed at a back surface 46*a* side, and allowing the common ink chamber 71 and the discharge channels 51 to individually communicate.

The common ink chamber 71 is a groove positioned in a rear-side end portion in the cover plate 46 and depressed toward the back side, and is arranged in the X direction in an extending manner. The common ink chamber 71 is configured to communicate into the passage member 26, and to allow the ink in the passage member 26 to circulate.

The slit 72 is formed in a position overlapping with the rising portion 51*b* of the discharge channel 51 in the Y direction, in the common ink chamber 71, and penetrates the cover plate 46 in the Y direction. That is, while the common ink chamber 71 communicates into the discharge channels 51 through the slits 72, the common ink chamber 71 does not communicate into the dummy channels 52. Note that the slit 72 is formed such that the width in the X direction is similar to the discharge channel 51.

The second head chip 40B is configured such that the actuator plate 45 and the cover plate 46 are laminated in the Y direction, similarly to the above-described first head chip 40A. In this case, the second head chip 40B is joined with the first head chip 40A in a state where the surface 46*b* of the cover plate 46 faces a back surface 45*b* of the actuator plate 45 in the first head chip 40A. That is, the discharge unit 22 of the present embodiment has a configuration in which a plurality of the actuator plates 45 and the cover plates 46 is alternately laminated.

A discharge channel 51 and a dummy channel 52 of the second head chip 40B are arranged to be shifted by a half pitch from an array pitch of the discharge channel 51 and the dummy channel 52 of the first head chip 40A, and the discharge channels 51 and the dummy channels 52 of the head chips 40A and 40B are arrayed in a in a zigzag manner. That is, the discharge channel 51 of the first head chip 40A and the dummy channel 52 of the second head chip 40B are opposed in the Y direction, and the dummy channel 52 of the first head chip 40A and the discharge channel 51 of the second head chip 40B are opposed in the Y direction.

Note that a communication hole (not illustrated) that connects the common ink chambers 71 of the head chips 40A and 40B is formed in a portion (non-discharge region) positioned outside the outermost channel (dummy channel 52) in the X direction, of the head chips 40A and 40B. The communication hole penetrates the actuator plate 45 (the actuator plate 45 at the first head chip 40A side) positioned between the cover plates 46, of the actuator plates 45, in the Y direction, and both end portions are individually opened in the common ink chambers 71 in the respective cover plates 46. Therefore, the ink flowing into the first head chip 40A (the common ink chamber 71) through the passage member 26 flows into the second head chip 40B (the common ink chamber 71) through the communication hole.

As illustrated in FIGS. 5 and 6, the FPC 33 is a so-called bump FPC, and one end portion in an extending direction thereof is connected to the discharge unit 22 to cover the rear-side end surface in the discharge unit 22. To be specific, the FPC 33 includes a plurality of pieces of individual electrode wiring (individual-side external wiring) 81 individually connected to the individual pads 67, and common electrode wiring (common-side external wiring) 82 connected to the common pad 64.

Each individual electrode wiring 81 includes an individual land portion 83 connected to the individual pad 67, and a pulled-out portion (not illustrated) pulled out from the individual land portion 83. Each individual land portion 83 is bonded to the corresponding individual pad 67 of the head chip 40A or 40B in the connection groove 55 through an anisotropic conductive film (ACF) (not illustrated). The pulled-out portion has one end portion connected to the individual land portion 83, and the other end connected to the IC substrate 32.

The common electrode wiring 82 includes the bump 85 connected to the common pad 64, and the pulled-out portion (not illustrated) individually pulled out from the bump 85.

The bump 85 is formed in a portion opposing the shallow groove portion 61 in the Z direction, the portion being of the FPC 33, and protrudes toward the front side. The bump 85 is individually accommodated in the shallow groove portion 61 through the dividing groove 54, and is electrically connected to the common pad 64 in the shallow groove portion 61. One end portion of the pulled-out portion is connected to the bump 85, and the other end portion is connected to an aggregation portion (not illustrated). The common electrode wiring 82 is connected to the IC substrate 32 through the aggregation portion.

As illustrated in FIGS. 4 to 6, the nozzle plate 44 is made of a film material having the thickness of about tens of μm, and is glued to the head chips 40A and 40B to cover the entire front-side end surfaces. Two nozzle arrays (the first nozzle array 42*a* and the second nozzle array 42*b*) formed of a plurality of nozzle holes (the first nozzle holes 41*a* and the second nozzle holes 41*b*) arranged in parallel with a space in the X direction are arranged on the nozzle plate 44.

The first nozzle array 42*a* includes a plurality of the first nozzle holes 41*a* penetrating the nozzle plate 44 in the Z direction, and is configured such that these first nozzle holes 41*a* are linearly arranged with spaces in the X direction. These first nozzle holes 41*a* communicate into the discharge channels 51 of the first head chip 40A. To be specific, the first nozzle holes 41*a* are formed in portions positioned in central portions of the discharge channels 51 in the first head chip 40A in the Y direction, the portions being of the nozzle plate 44, and are formed at the same pitch as the discharge channels 51.

The second nozzle array 42*b* includes a plurality of the second nozzle holes 41*b* penetrating the nozzle plate 44 in the Z direction, and is arranged in parallel to the first nozzle array 42*a*. The second nozzle holes 41*b* communicate into the discharge channels 51 of the second head chip 40B. To be specific, the second nozzle holes 41*b* are formed in portions positioned in central portions of the discharge channels 51 in the second head chip 40B in the Y direction, the portions being of the nozzle plate 44, and are formed at the same pitch as the discharge channels 51. Therefore, the dummy channels 52 do not communicate into the nozzle holes 41*a* and 41*b*, and are covered with the nozzle plate 44 from the front side.

[Method of Operating Printer]

Next, a case of recording texts, figures, and the like on the recording medium S using the printer 1 configured as described above will be herein described.

Note that, as an initial state, different colors of inks are sufficiently filled in the respective four ink tanks 10 illustrated in FIG. 1.

Under such an initial state, when the printer 1 is operated, the grid rollers 2*a* and 3*a* of the conveying mechanisms 2 and 3 are rotated, so that the recording medium S between the grid rollers 2*a* and 3*a* and the pinch rollers 2*b* and 3*b* is conveyed toward the X direction. Further, at the same time, the drive motor 20 rotates the pulleys 18 to cause the endless belt 19 to travel. Accordingly, the carriage 16 reciprocatively moves in the Y direction while being guided by the guide rails 14 and 15.

During the movement, the four colors of inks are appropriately discharged on the recording medium S with the inkjet heads 4, whereby texts, images, and the like can be recorded.

Here, movement of the inkjet heads 4 will be described below in detail.

In the inkjet head 4, a voltage is applied between the electrodes 62 and 66 through the FPC 33 so that the common electrodes 62 become to have a reference potential GND, and the individual electrodes 66 become to have a drive potential Vdd. Then, thickness slip deformation is caused in two drive walls 53 that define the discharge channel 51, and these two drive walls 53 are deformed to protrude to the dummy channel 52 sides. That is, the polarizing direction of the actuator plate 45 of the present embodiment is one direction, and the electrodes 62 and 66 are formed only up to the intermediate portions of the drive walls 53 in the Y direction. Therefore, when the voltage is applied between the electrodes 62 and 66, the drive walls 53 are bent and deformed in a V-shaped manner based on the intermediate portions in the drive walls 53 in the Y direction. Accordingly, the discharge channel 51 is deformed as if the discharge channel 51 expands.

As described above, the capacity of the discharge channel 51 is increased due to the piezoelectric thickness slip effect of the deformation of the two drive walls 53. Then, due to the increase in the capacity of the discharge channel 51, the ink stored in the common ink chamber 71 is guided to the discharge channel 51. The ink guided to the inside of the discharge channel 51 is propagated in the inside of the discharge channel 51 as pressure waves, and at timing when the pressure waves reach the nozzle holes 41*a* and 41*b*, the voltage applied between the electrodes 62 and 66 is caused to be zero. Accordingly, the drive walls 53 are restored, and the once-increased capacity of the discharge channel 51 is returned to the original capacity. With this operation, the pressure inside the discharge channel 51 is increased, and the ink is pressurized. As a result, the ink in a droplet manner is discharged to an outside through the nozzle holes 41*a* and 41*b*, whereby texts, images, and the like can be recorded on the recording medium S.

[Method of Manufacturing Discharge Unit]

Next, a method of manufacturing the discharge unit 22 will be described. In the description below, a method of collectively manufacturing a plurality of the discharge units 22 by joining an actuator wafer 101 in which a plurality of the actuator plates 45 continues in the Z direction and a cover wafer 102 in which a plurality of the cover plates 46 continues in the Z direction, forming the wafer joined body 103, and cutting the wafer joined body 103 will be described.

A method of manufacturing the discharge unit 22 of the present embodiment mainly includes an actuator wafer manufacturing process, a cover wafer manufacturing process, and an assembly process. Among the processes, the actuator wafer manufacturing process and the cover wafer manufacturing process can be performed in parallel.

<Actuator Wafer Manufacturing Process>

Figure 7:
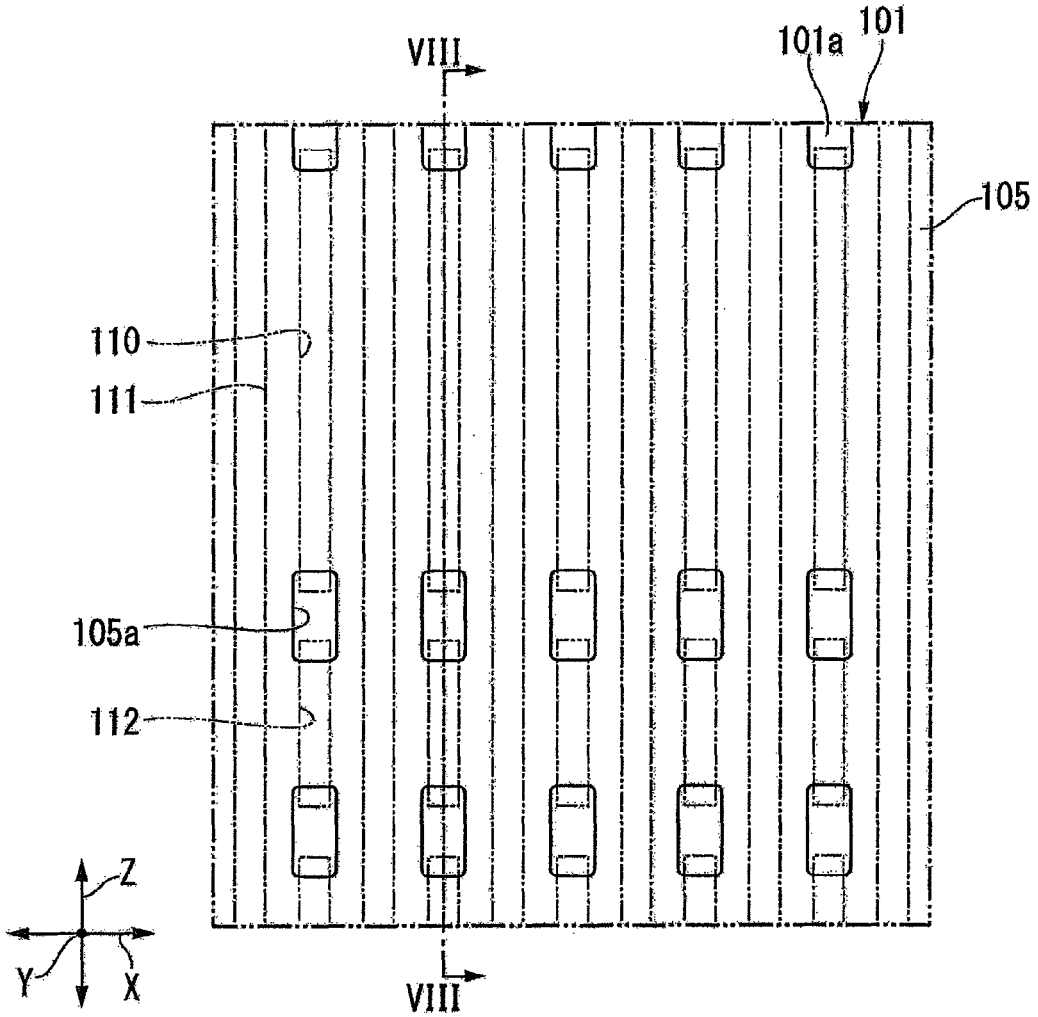
FIG. 7 is a process diagram for describing an actuator wafer manufacturing process (mask forming process), and is a plan view of an actuator wafer.

FIG. 7 is a process diagram for describing the actuator wafer manufacturing process (mask forming process), and is a plan view of an actuator wafer 101. Further, FIG. 8 is a sectional view along the VIII-VIII line of FIG. 7.

Figure 8:
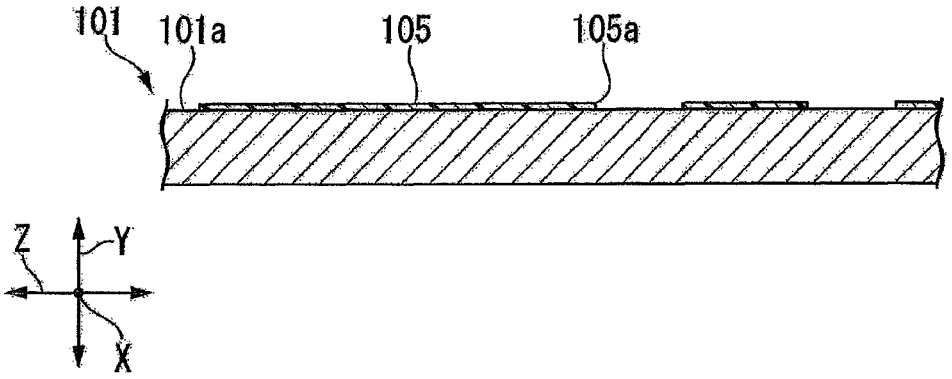
FIG. 8 is a sectional view along the VIII-VIII line of FIG. 7.

As illustrated in FIGS. 7 and 8, in the actuator wafer manufacturing process, first, a mask 105 to be used in a subsequent electrode forming process is formed on a surface 101*a* of the actuator wafer 101 (mask forming process). To be specific, first, for example, a mask material such as a photosensitive dry film is stuck to the surface 101*a* of the actuator wafer 101. Following that, the mask material is patterned using a photolithography technology, so that the mask material on a portion positioned in a forming region of the common wiring 63, of the mask material, is removed. Accordingly, the mask 105 having an opening portion 105*a* in the portion positioned in the forming region of the common wiring 63 is formed.

Figure 9:
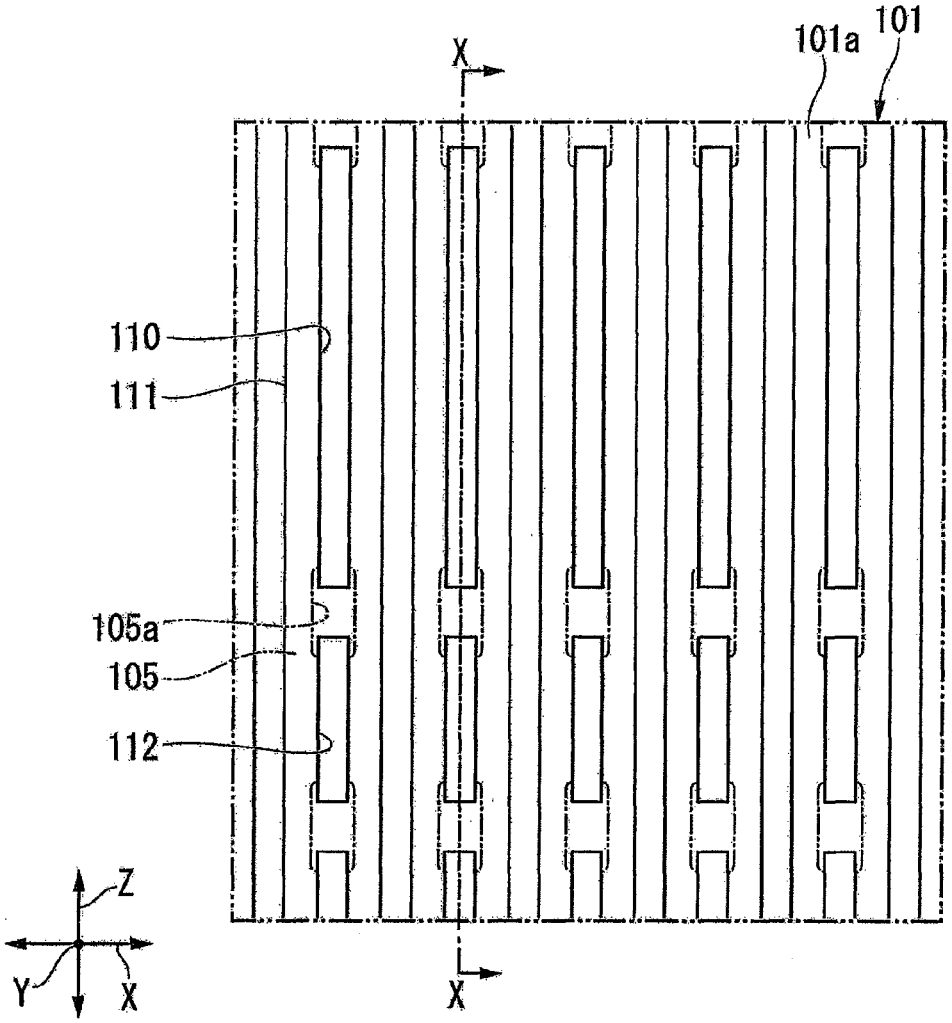
FIG. 9 is a process diagram for describing an actuator wafer manufacturing process (dicing line forming process), and is a plan view of an actuator wafer.
Figure 10:
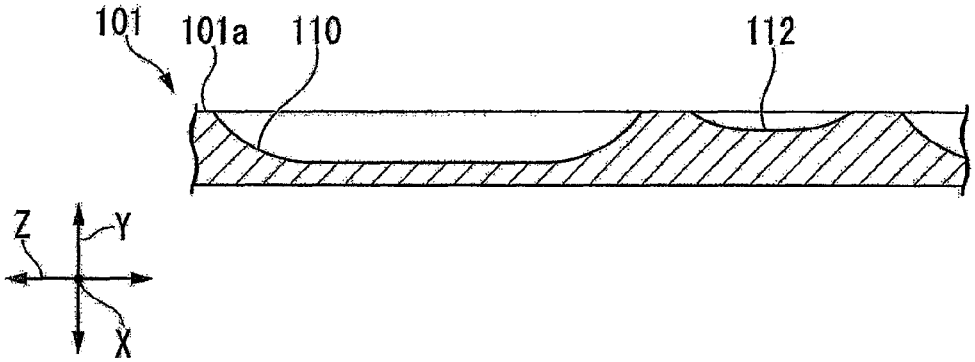
FIG. 10 is a sectional view along the X-X line of FIG. 9.

FIG. 9 is a process diagram for describing a dicing line forming process, and is a plan view of an actuator wafer 101. Further, FIG. 10 is a sectional view along the X-X line of FIG. 9. Note that, in FIG. 9 and subsequent drawings, the mask 105 (an opening portion 105*a*) is illustrated by the chain lines.

Following that, as illustrated in FIGS. 9 and 10, a first dicing line 110 that is to serve as the discharge channel 51 later is formed by cutting or the like using a dicer (not illustrated) (first dicing line forming process (channel forming process)). To be specific, the dicer is brought to enter the actuator wafer 101 from the surface 101*a* side, and the dicer is caused to travel in the Z direction. Accordingly, the actuator wafer 101 is cut with the mask 105. Following that, the dicer is caused to travel by a predetermined amount, and is retracted from the actuator wafer 101. Accordingly, the first dicing line 110 is formed.

At this time, in side view as viewed from the X direction, both end portions of the first dicing line 110 in the Z direction correspond to the rising portions 51*b*, and have arc shapes following the radius of curvature of the dicer. Note that the length of the first dicing line 110 in the Z direction (a travel amount of the dicer) is set to be a length of two discharge channels 51 (extending portions 51*a*) or more. Then, in the first dicing line forming process, the above-described operation is repeatedly performed for the actuator wafer 101 with spaces in the Z direction and in the X direction, and the plurality of first dicing lines 110 is formed. That is, in the actuator wafer 101, the rear-side end portions and the front-side end portions in the actuator plate 45 continue in a facing state.

Next, a second dicing line 111 that is to serve as the dummy channel 52 later is formed (second dicing line forming process (channel forming process)). To be specific, the dicer is brought to enter portions positioned at both ends of the first dicing line 110 in the actuator wafer 101 in the X direction, and the dicer is caused to travel throughout the actuator wafer 101 in the Z direction. Accordingly, the actuator wafer 101 is cut with the mask 105. In the present embodiment, the process depth with the dicer is entirely equal in the Z direction.

Next, a third dicing line 112 that is to serve as the shallow groove portion 61 later is formed (third dicing line forming process (recessed portion forming process)). To be specific, the dicer is brought to enter a portion positioned between the first dicing lines 110 adjacent in the Z direction, of the actuator wafer 101, and the dicer is caused to travel in the Z direction by a predetermined amount. Accordingly, the actuator wafer 101 is cut with the mask 105. At this time, in side view as viewed from the X direction, both end portions of the third dicing line 112 in the Z direction have arc shapes following the radius of curvature of the dicer. Note that the length of the third dicing line 112 in the Z direction is longer than twice the length of the shallow groove portion 61. Further, the order to form the dicing lines 110 to 112 can be appropriately changed. For example, the first dicing line 110 and the third dicing line 112 may be formed in the same process using the same dicer.

Figure 11:
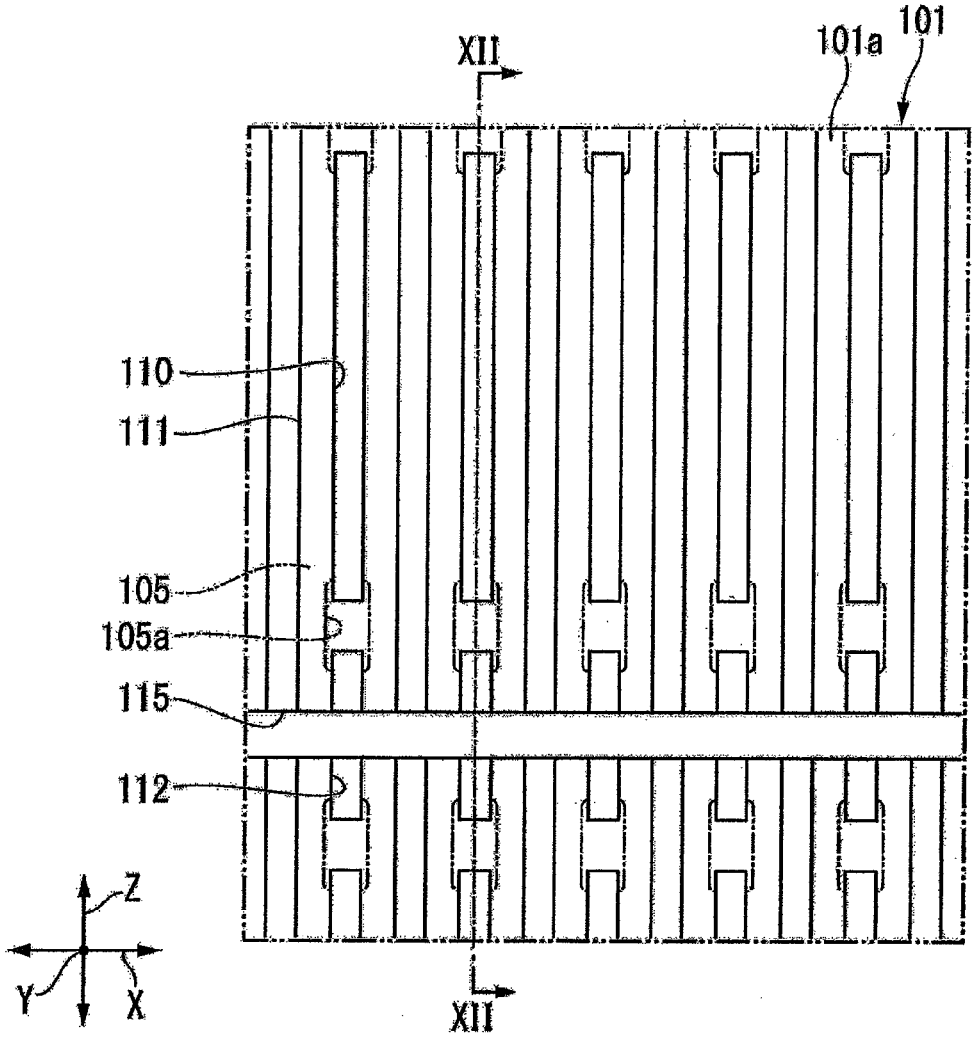
FIG. 11 is a process diagram for describing an actuator wafer manufacturing process (crossing groove forming process), and is a plan view of an actuator wafer.
Figure 12:
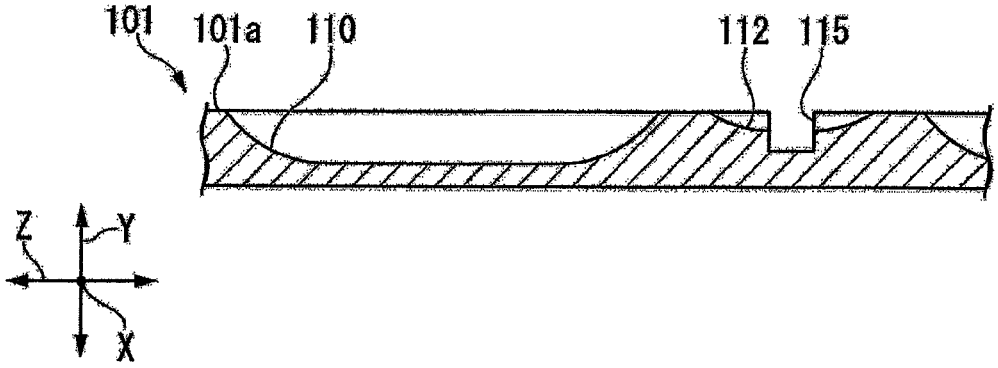
FIG. 12 is a sectional view along the XII-XII line of FIG. 11.

FIG. 11 is a process diagram for describing a crossing groove forming process, and is a plan view of an actuator wafer 101. FIG. 12 is a sectional view along the XII-XII line of FIG. 11.

Following that, as illustrated in FIGS. 11 and 12, a crossing groove 115 that crosses the actuator wafer 101 in the X direction is formed (crossing groove forming process). To be specific, the dicer is brought to enter a position corresponding to the intermediate portion of the third dicing line 112 in the Z direction from the surface 101*a*, of the actuator wafer 101, and the dicer is caused to travel throughout the actuator wafer 101 in the X direction. Accordingly, the crossing groove 115 perpendicular to the second dicing line 111 and the third dicing line 112, and which divides the third dicing line 112 into halves in the Z direction, is formed.

Note that, in the channel forming process and the crossing groove forming process, the dimensions such as the groove widths and the groove depths of the first and second dicing lines 110 and 111 and the crossing groove 115 are set not to allow an electrode material 120 to deposit on the bottom surfaces of the first and second dicing lines 110 and 111 in the electrode forming process described below. In the illustrated example, in the crossing groove 115, the groove width in the Z direction is wider than the groove widths of the dicing lines 110 to 112 in the X direction, and the groove depth in the Y direction is shallower than the first and second dicing lines 110 and 111 and is deeper than the third dicing line 112.

Figure 13:
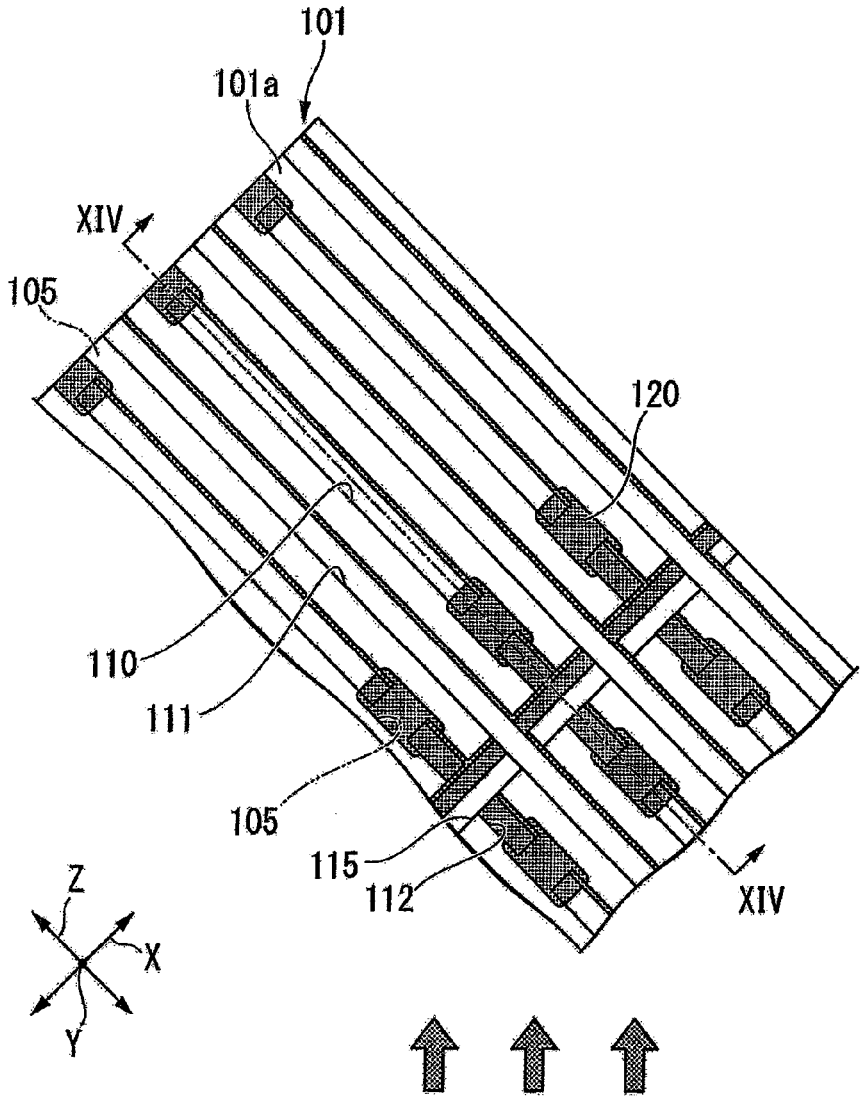
FIG. 13 is a process diagram for describing an actuator wafer manufacturing process (electrode forming process), and is a plan view of an actuator wafer.
Figure 14:
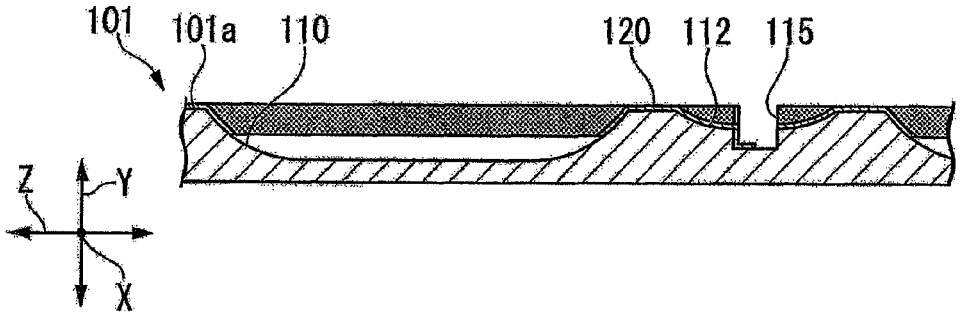
FIG. 14 is a sectional view along the XIV-XIV line of FIG. 13.

FIG. 13 is a process diagram for describing the electrode forming process, and is a plan view of an actuator wafer. FIG. 14 is a sectional view along the XIV-XIV line of FIG. 13.

Following that, as illustrated in FIGS. 13 and 14, the electrode material 120 that is to serve as the common electrode 62, the common wiring 63, and the common pad 64, as well as the individual electrode 66, and the individual pad 67 is formed on the actuator wafer 101 (electrode forming process). In the electrode forming process, the electrode material 120 is formed by so-called oblique deposition in which deposition is performed by inclining a normal direction (Y direction) of the surface 101*a* in the actuator wafer 101, and a depositing direction (a direction in which the electrode material is deposited) of the electrode material 120 emitted from a deposition source. In the present embodiment, the deposition process is performed from each of positions corresponding to the respective corner portions of the actuator wafer 101, in plan view as viewed from the Y direction. That is, in the present embodiment, the actuator wafer 101 and the deposition source are relatively rotated by 90° during each deposition process, and at least four times of deposition processes are performed.

In the deposition process, when the oblique deposition is performed from the position corresponding to one corner portion of the actuator wafer 101, the electrode material 120 is emitted from the deposition source toward a direction intersecting with the extending directions (the X direction and the Z direction) of the dicing lines 110 to 112 and the crossing groove 115 by 45°. The electrode material 120 emitted from the deposition source is deposited on the surface 101*a* of the actuator wafer 101 through the opening portion 105*a* of the mask 105. Further, the electrode material 120 is also deposited on the inner surfaces of the dicing lines 110 to 112 and the crossing groove 115 through the dicing lines 110 to 112 and the crossing groove 115.

Figure 15:
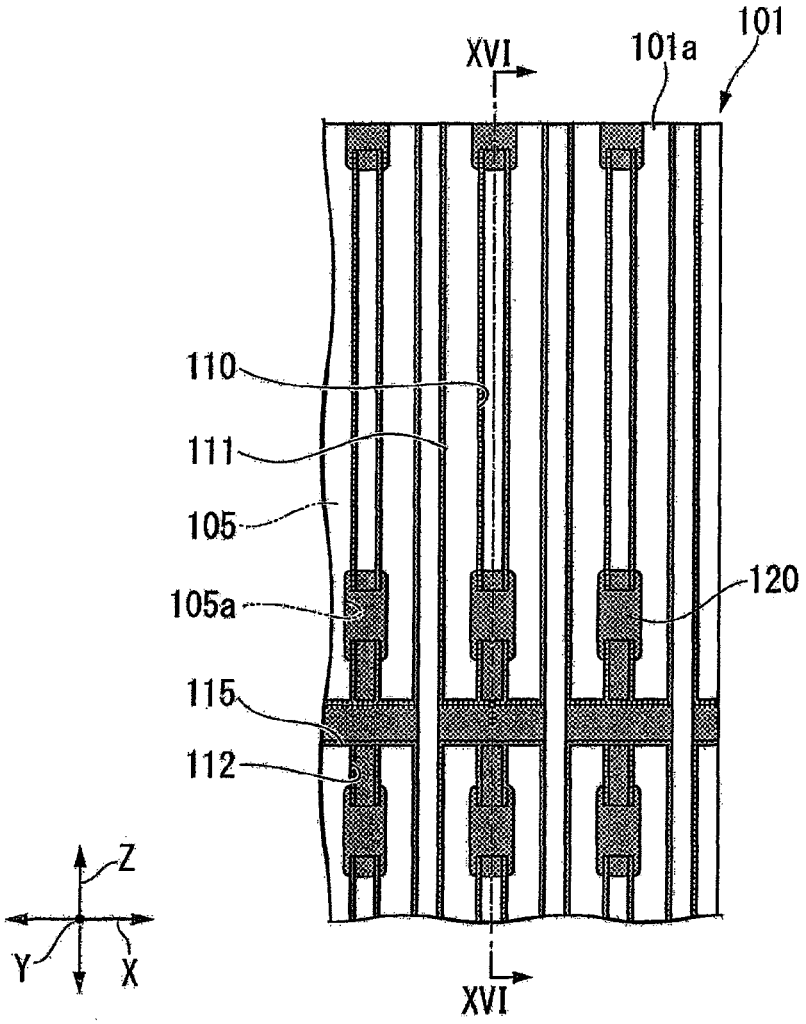
FIG. 15 is a process diagram for describing an actuator wafer manufacturing process (electrode forming process), and is a plan view of an actuator wafer.
Figure 16:
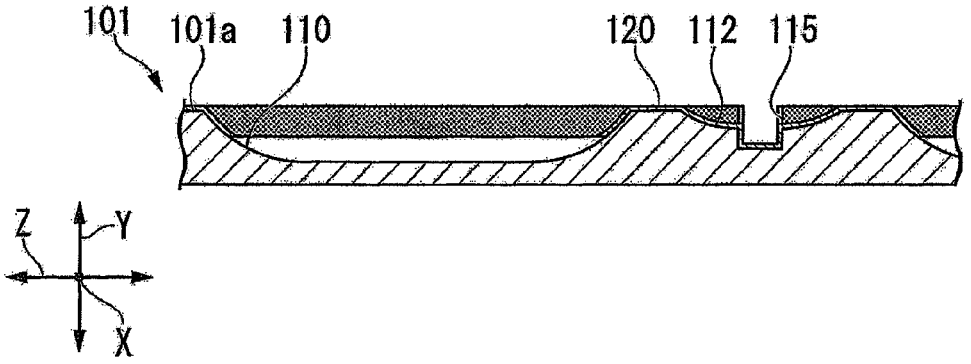
FIG. 16 is a sectional view along the XVI-XVI line of FIG. 15.

In the deposition process, the electrode material 120 is deposited on a portion positioned at a depth side in the depositing direction (a portion opposing the depositing direction) of the inner surfaces of the dicing lines 110 to 112 and the crossing groove 115, and the electrode material 120 is not deposited on a portion positioned at a front side in the depositing direction (a portion facing the same direction as the depositing direction). Then, the above-described deposition process is performed from the position corresponding to each of the corner positions of the actuator wafer 101, so that the electrode material 120 is formed on the surface 101*a* of the actuator wafer 101 and desired regions in the inner surfaces of the dicing lines 110 to 112 and the crossing groove 115. Accordingly, as illustrated in FIGS. 15 and 16, the electrode material 120 that is to serve as the common electrode 62 and the individual electrode 66 is formed on portions from the surface-side end edges of the first dicing line 110 and the second dicing line 111 to the intermediate portions. The electrode material 120 that is to serve as the common pad 64 is formed on the entire inner surface of the third dicing line 112. Further, the electrode material 120 that is to serve as the individual pad 67 is formed on the entire inner surface of the crossing groove 115. Then, after completion of all of the deposition processes, the mask 105 on the actuator wafer 101 is removed. Note that, in the electrode forming process, the electrode material 120 may be selectively formed on the forming region of the electrode material 120 by patterning or the like using various types of film forming methods such as plating, in addition to the above-described deposition.

Figure 17:
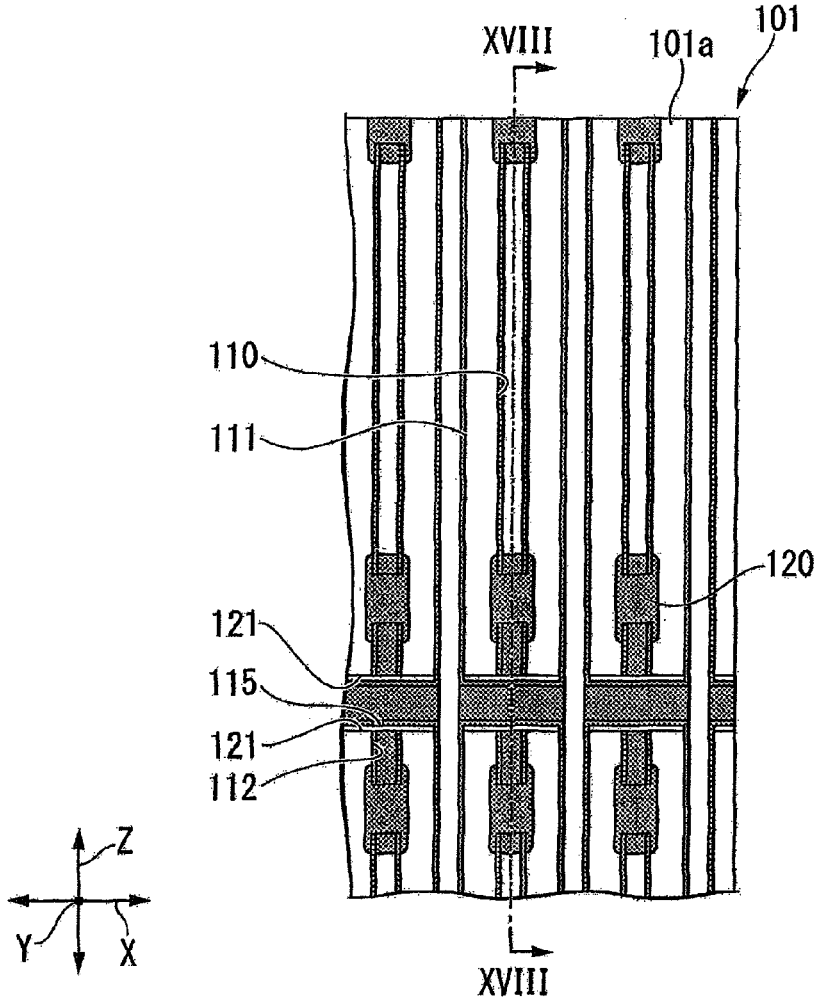
FIG. 17 is a process diagram for describing an actuator wafer manufacturing process (electrode separating process), and is a plan view of an actuator wafer.
Figure 18:
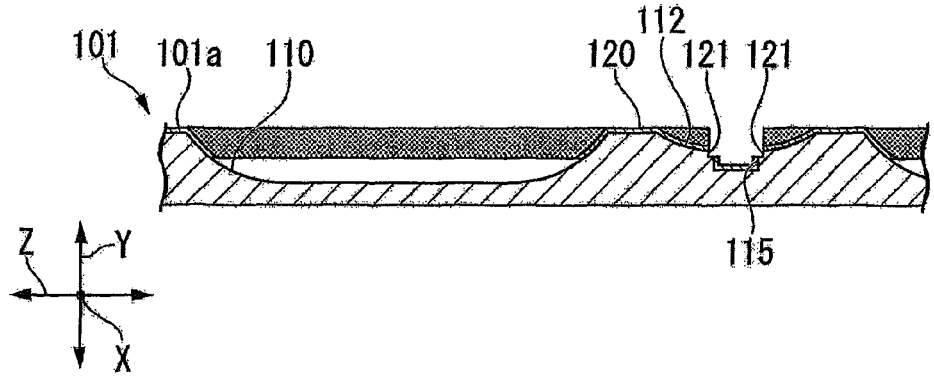
FIG. 18 is a sectional view along the XVIII-XVIII line of FIG. 17.

FIG. 17 is a process diagram for describing an electrode separating process, and is a plan view of an actuator wafer. FIG. 18 is a sectional view along the XVIII-XVIII line of FIG. 17.

Next, as illustrated in FIGS. 17 and 18, the electrode separating process (dividing process) of separating a portion positioned in the third dicing line 112, and portions positioned in the second dicing line 111 and the crossing groove 115, of the electrode material 120, is performed. To be specific, the dicer is caused to travel to the corner portion made by the surface 101*a* of the actuator wafer 101 and the inner surface of the crossing groove 115 in the X direction, and a dividing dicing line 121 that is to serve as the dividing groove 54 later is formed. At this time, the process depth with the dicer is set to a depth not to divide the portion positioned in bottom surface of the electrode material 120 formed on the inner surface of the crossing groove 115 and the portion positioned in the second dicing line 111. Accordingly, a portion positioned at the surface side in the crossing groove 115 is removed in a state where the portion positioned in the second dicing line 111 and the portion positioned in the crossing groove 115, of the electrode material 120, are connected. Note that, in the electrode separating process, the corner portion made by the surface 101*a* of the actuator wafer 101 and the inner surface of the crossing groove 115 is removed one by one using a dicer having a narrower width than the crossing groove 115. Note that corner portions opposed in the Z direction may be collectively removed using a dicer having a wider width than the crossing groove 115.

Thereby, the actuator wafer manufacturing process has been terminated.

<Cover Wafer Manufacturing Process>

Figure 19:
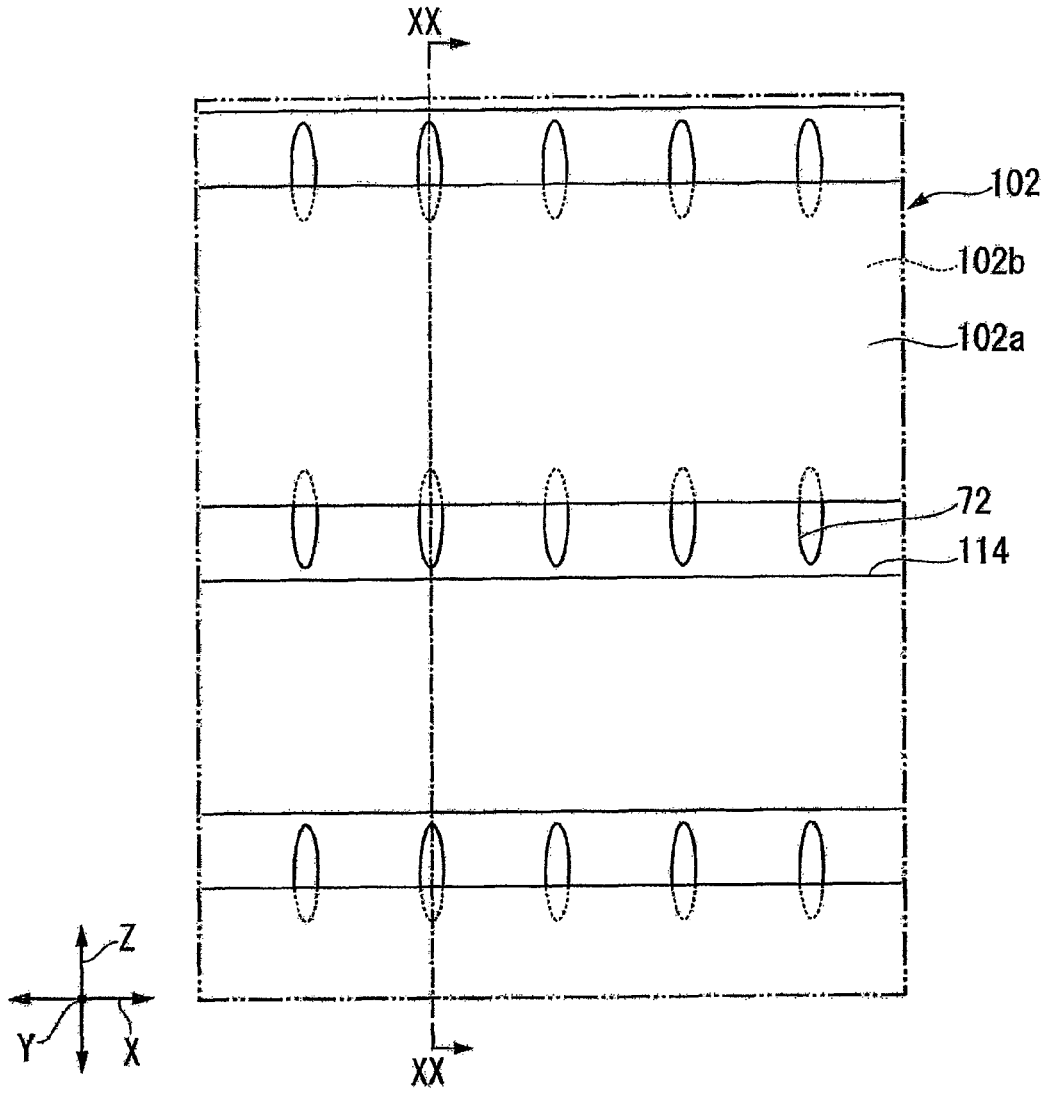
FIG. 19 is a process diagram for describing a cover wafer manufacturing process, and is a plan view of a cover wafer.
Figure 20:
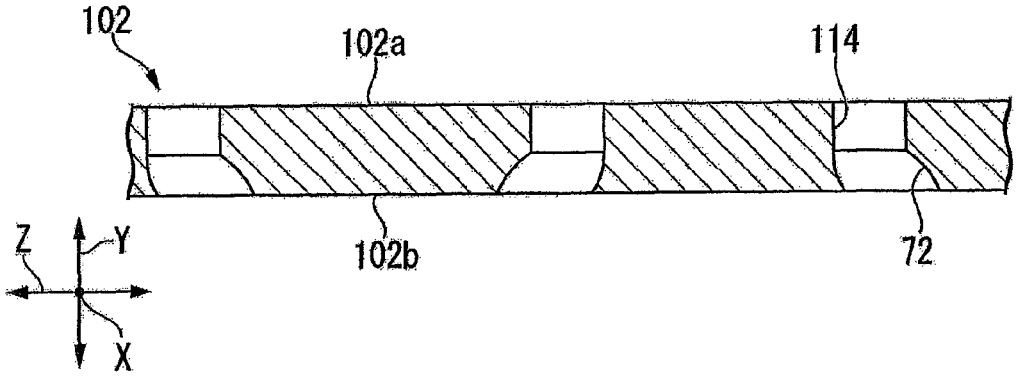
FIG. 20 is a sectional view along the XX-XX line of FIG. 19.

FIG. 19 is a process diagram for describing a cover wafer manufacturing process, and is a plan view of the cover wafer 102. FIG. 20 is a sectional view corresponding to the XX-XX line of FIG. 19.

As illustrated in FIGS. 19 and 20, in the cover wafer manufacturing process, first, sandblast or the like is performed for the cover wafer 102 through a mask (not illustrated) from a surface 102*a* side, and a groove portion 114 that is to serve as the common ink chamber 71 is formed (common ink chamber forming process). At this time, the groove portion 114 is formed in a portion corresponding to the both end portions of the first dicing line 110 in the Z direction, in the cover wafer 102 along the X direction.

Following that, the sandblast or the like is performed for the cover wafer 102 through the mask (not illustrated) from the back surface 102*b* side, and slits 72 individually communicating into the common ink chamber 71 are formed (slit forming process). At this time, the slits 72 are individually formed in portions corresponding to the both end portions of the first dicing line 110 in the Z direction, in the cover wafer 102. Note that the processes of the cover wafer forming process may be performed by dicing or the like, other than the sandblast.

<Assembly Process>

Figure 21:
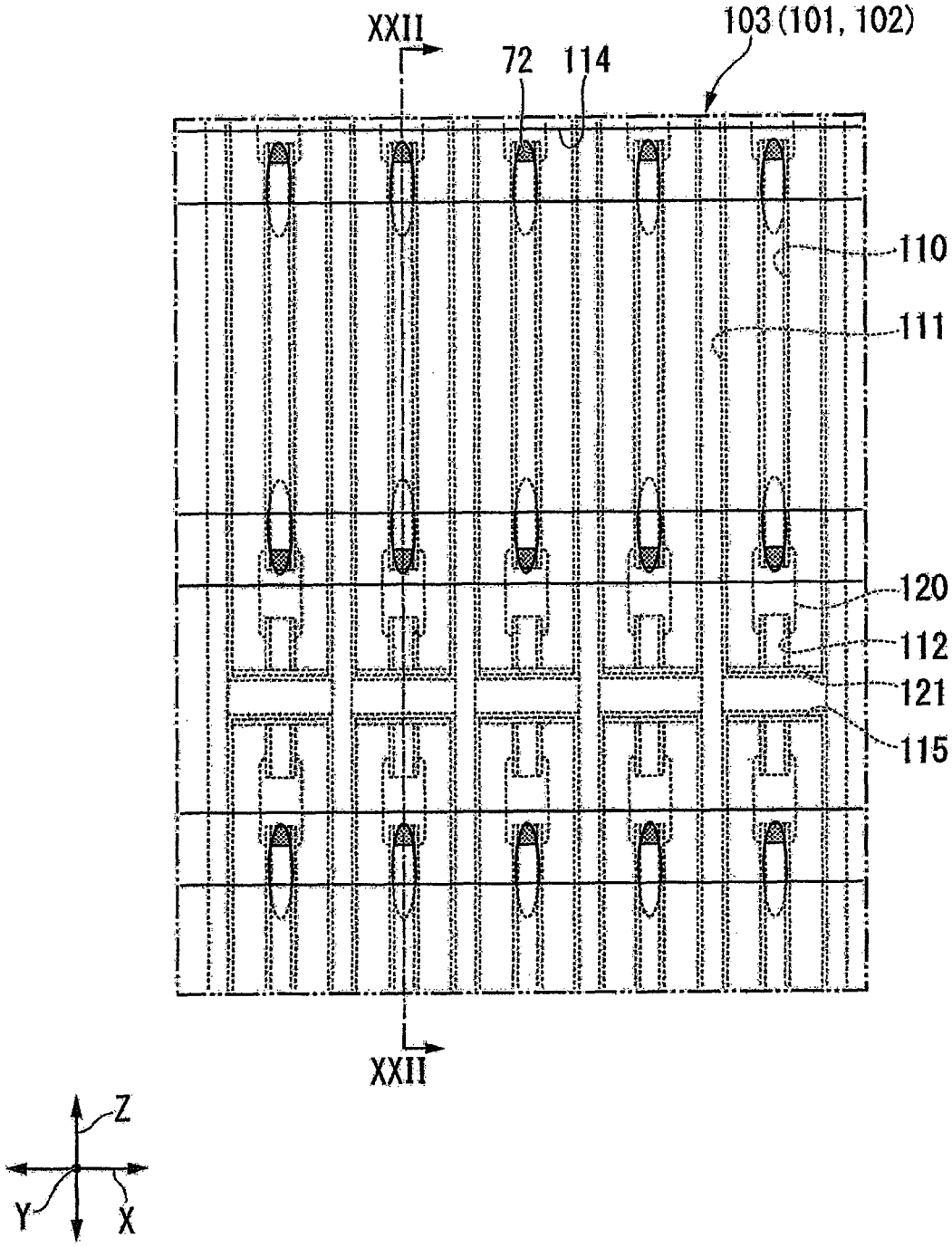
FIG. 21 is a process diagram of a pasting process, and is a plan view of a wafer joined body.
Figure 22:
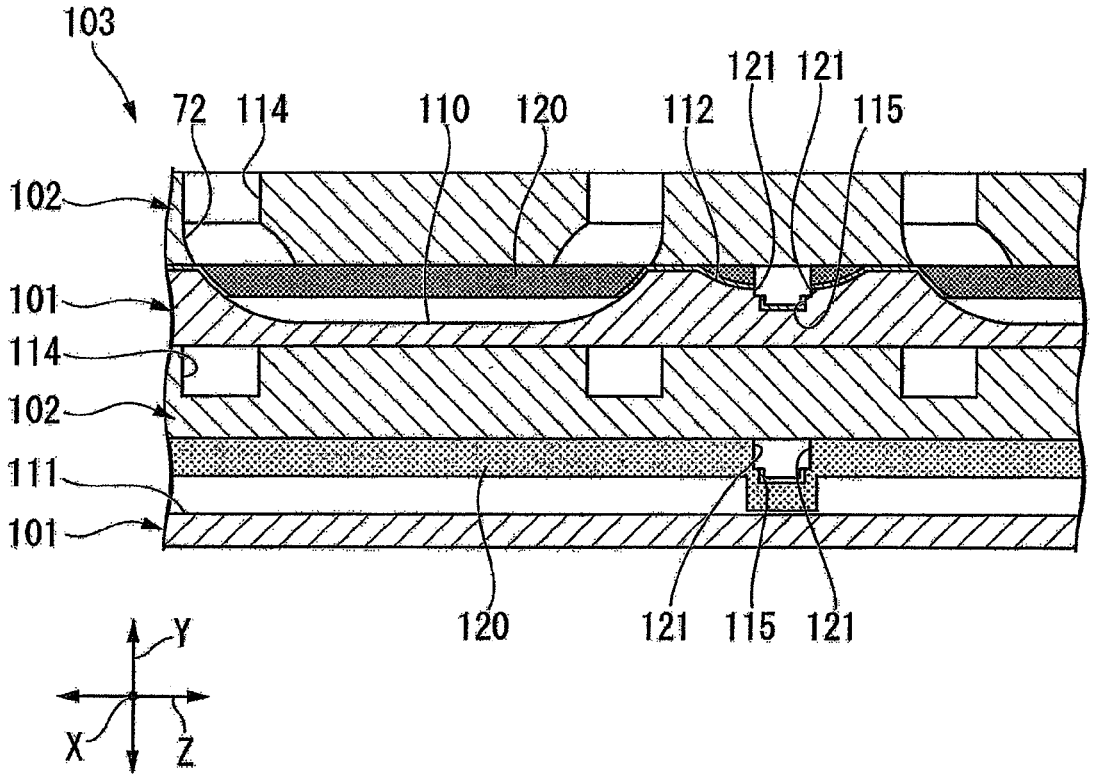
FIG. 22 is a sectional view along the XXII-XXII line of FIG. 21.

FIG. 21 is a process diagram of a pasting process, and is a plan view of the wafer joined body 103. FIG. 22 is a sectional view along the XXII-XXII line of FIG. 21.

As illustrated in FIGS. 21 and 22, in the assembly process, first, a plurality of the actuator wafers 101 and the cover wafers 102 are alternately laminated to have the wafer joined body 103 (pasting process). To be specific, the cover wafers 102 and the actuator wafers 101 that are to serve as the head chips 40A and 40B are pasted, and then, the cover wafer 102 that is to serve as the second head chip 40B is pasted to the actuator wafer 101 that is to serve as the first head chip 40A.

Figure 23:
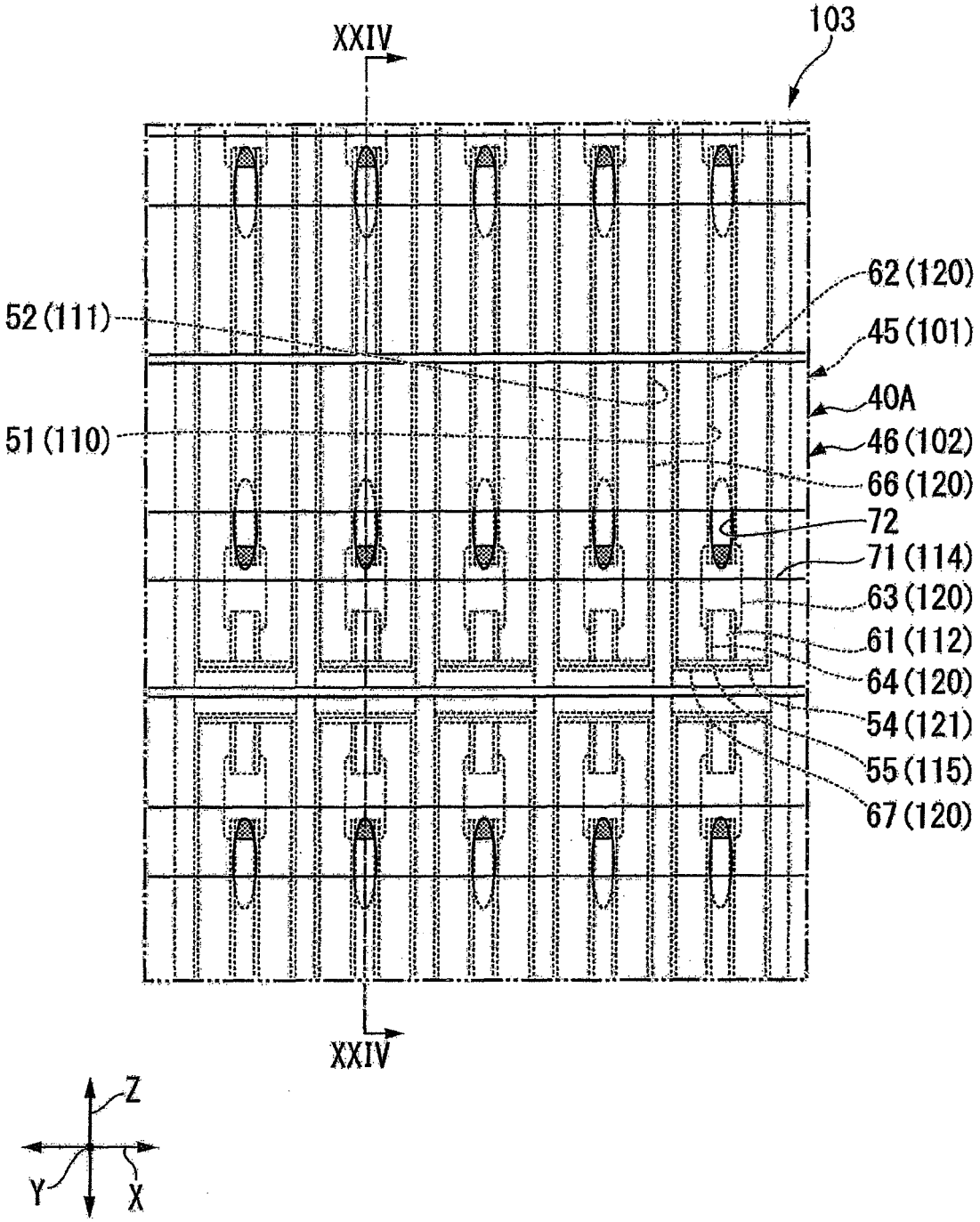
FIG. 23 is a process diagram of an individualizing process, and is a plan view of the wafer joined body.
Figure 24:
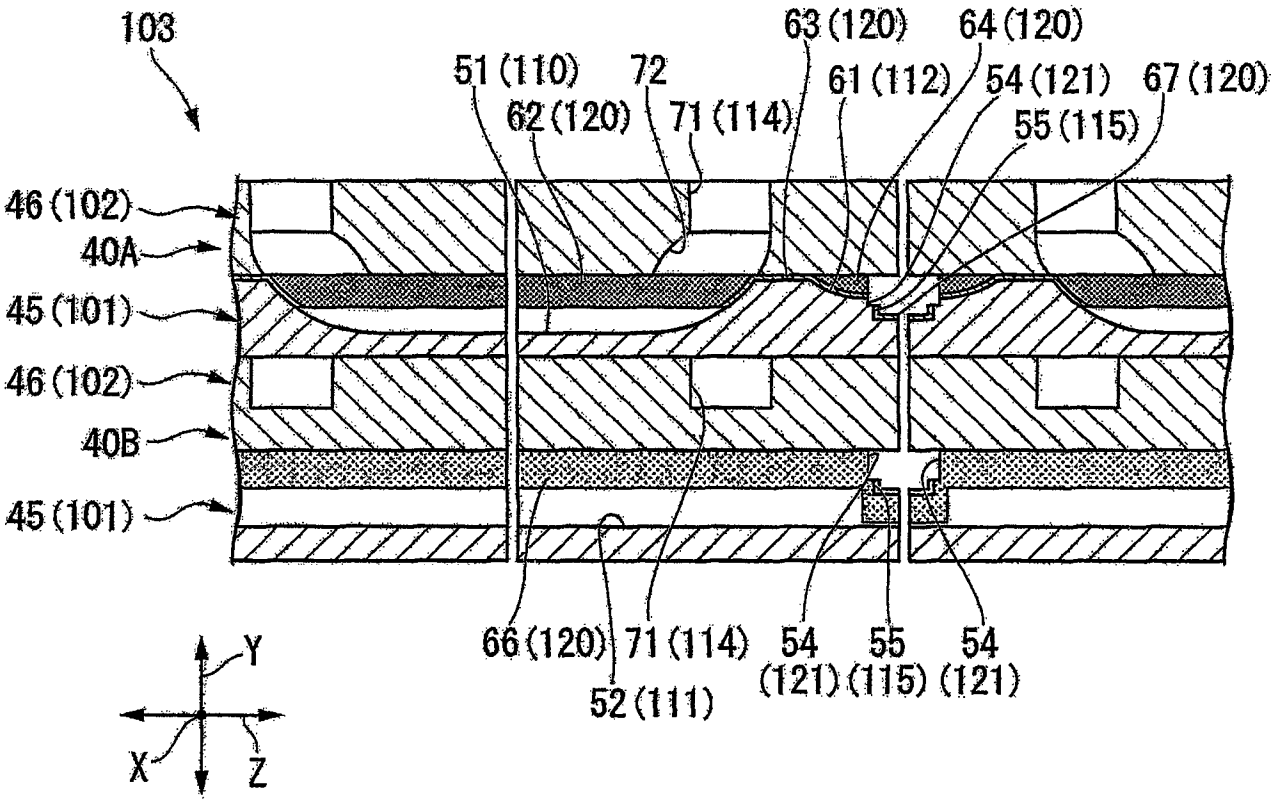
FIG. 24 is a sectional view along the XXIV-XXIV line of FIG. 23.

FIG. 23 is a process diagram of an individualizing process, and is a plan view of the wafer joined body 103. FIG. 24 is a sectional view along the XXIV-XXIV line of FIG. 23.

Following that, as illustrated in FIGS. 23 and 24, the wafer joined body 103 is cut for each discharge unit 22 (individualizing process). To be specific, the wafer joined body 103 is cut by causing the dicer to travel in the X direction, for the intermediate positions of the first dicing lines 110 and the intermediate position of the crossing groove 115 in the Z direction, of the wafer joined body 103. At this time, the first dicing lines 110 are divided at the intermediate positions in the Z direction, and the crossing groove 115 is divided at the intermediate position in the Z direction. Accordingly, a plurality of the discharge units 22 in which the first head chip 40A and the second head chip 40B are laminated is cut off from one sheet of wafer joined body 103. At this time, the portion corresponding to the crossing groove 115, of the discharge unit 22, configures the connection groove 55.

As described above, in the present embodiment, the FPC 33 is connected to the common pad 64 formed in the shallow groove portion 61 and the individual pad 67 formed in the connection groove 55, so that the actuator plate 45 and the FPC 33 can be connected from the rear side of the actuator plate 45. Accordingly, the wiring pattern can be simplified compared with a conventional configuration to pull the individual electrode and the common electrode up to the individual pad and the common pad formed on the back surface of the actuator plate.

Further, the common pad 64 is formed in the shallow groove portion 61, so that a contact area of the FPC 33 and the common pad 64 can be secured compared with a case of connecting the common pad formed on the surface of the actuator plate to the FPC from the rear side. Accordingly, the electrical reliability can be secured.

Then, the connection between the actuator plate 45 and the FPC 33 is performed for the actuator plate 45 from the rear side, so that the head chips 40A and 40B can be easily laminated in the Y direction. In this case, multi nozzles can be achieved after downsizing is achieved compared with a case of achieving the multi nozzles using a plurality of the inkjet heads 4.

Especially, in the present embodiment, all of various types of wiring that connect the common electrode 62 and the individual electrode 66, and the FPC 33 are formed in the actuator plate 45. Therefore, for example, it is not necessary to form the electrode material after the paste of the plates 45 and 46, which is different from a case of forming the various types of wiring throughout the plates 45 and 46, and the manufacturing efficiency and a yield can be improved.

Further, the individual pad 67 is formed on the inner surface of the connection groove 55 depressed in the rear-side end surface of the actuator plate 45 by one step. Therefore, interference between the individual pad 67 and peripheral members is suppressed, and the individual pad 67 can be protected.

Further, the groove depth of the dummy channel 52 is deeper than the groove depth of the connection groove 55. Therefore, for example, when the individual pad 67 is formed by the oblique deposition, the electrode material 120 less easily adheres to the bottom surface of the dummy channel 52. As a result, it is not necessary to perform a removing process of removing the electrode material adhering to the bottom surface of the second dicing line 111 (dummy channel 52) after the electrode forming process. Therefore, the manufacturing efficiency can be improved.

Further, the bump 85 accommodated in the shallow groove portion 61 of the actuator plate 45 is formed in the common electrode wiring 82 of the FPC 33. Therefore, the electrical reliability between the FPC 33 and the common pad 64 can be easily secured. At this time, the third dicing line 112 that is to serve as the shallow groove portion 61 is formed in a preceding part of the electrode forming process, so that the electrode material 120 that is to serve as the common pad 64 can be formed on the inner surface of the third dicing line 112 at the same time with the inside surface of the first and second dicing lines 110 and 111 in the electrode forming process. Note that the electrode material 120 that is to serve as the common pad 64 may be selectively formed on the forming region of the common pad 64 by patterning or the like using various types of film forming methods such as plating, in addition to the above-described deposition.

Further, in the present embodiment, the plurality of discharge units 22 is connectively manufactured from the wafer joined body 103, whereby wafer-level work can be performed and the manufacturing efficiency can be improved.

At this time, the crossing groove 115 is formed in a preceding part of the electrode forming process, so that the electrode material 120 can be formed on the inner surface of the crossing groove 115 at the same time with the inside surfaces of the dicing lines 110 to 112 in the electrode forming process. Then, the actuator wafer 101 is individualized at the crossing groove 115, so that the actuator plate 45 in which the individual pad 67 is formed in the connection groove 55 can be taken out. In this case, the manufacturing efficiency can be further improved compared with a case of forming the individual pad 67 after the individualization.

Further, in the electrode forming process, the oblique deposition is performed for the surface 101*a* of the actuator wafer 101 from the direction intersecting with the X direction and the Z direction, whereby the electrode material can be easily deposited on the corner portion made by the second dicing line 111 and the crossing groove 115 compared with a case of performing the oblique deposition along the X direction or the Z direction. Therefore, the electrical reliability between the individual electrode 66 and the individual pad 67 can be secured.

Then, the printer 1 of the present embodiment includes the above-described inkjet heads 4. Therefore, the wiring pattern can be simplified, and a highly reliable printer 1 can be provided.

Note that the technical scope of the present invention is not limited to the above-described embodiment, and various changes can be added without departing from the gist of the present invention.

For example, in the above-described embodiment, the inkjet printer 1 has been exemplarily described as an example of a liquid injection device. However, the liquid injection device is not limited to the printer. For example, a facsimile machine, an on-demand printer, or the like may be employed.

In the above-described embodiment, a case in which the nozzle arrays 42*a* and 42*b* linearly extend along the X direction has been described. However, an example is not limited to the case, and for example, the nozzle arrays 42*a* and 42*b* may obliquely extend.

The shapes of the nozzle holes 41*a* and 41*b* are not limited to the circular shape. For example, a polygonal shape such as a triangular shape, an elliptical shape, or a star shape may be employed.

In the above-described embodiment, a configuration in which the discharge channels 51, and the dummy channels 52 are arrayed to be shifted by a half pitch in a zigzag manner, between the head chips 40A and 40B, has been described. However, an example is not limited to the configuration.

Figure 25:
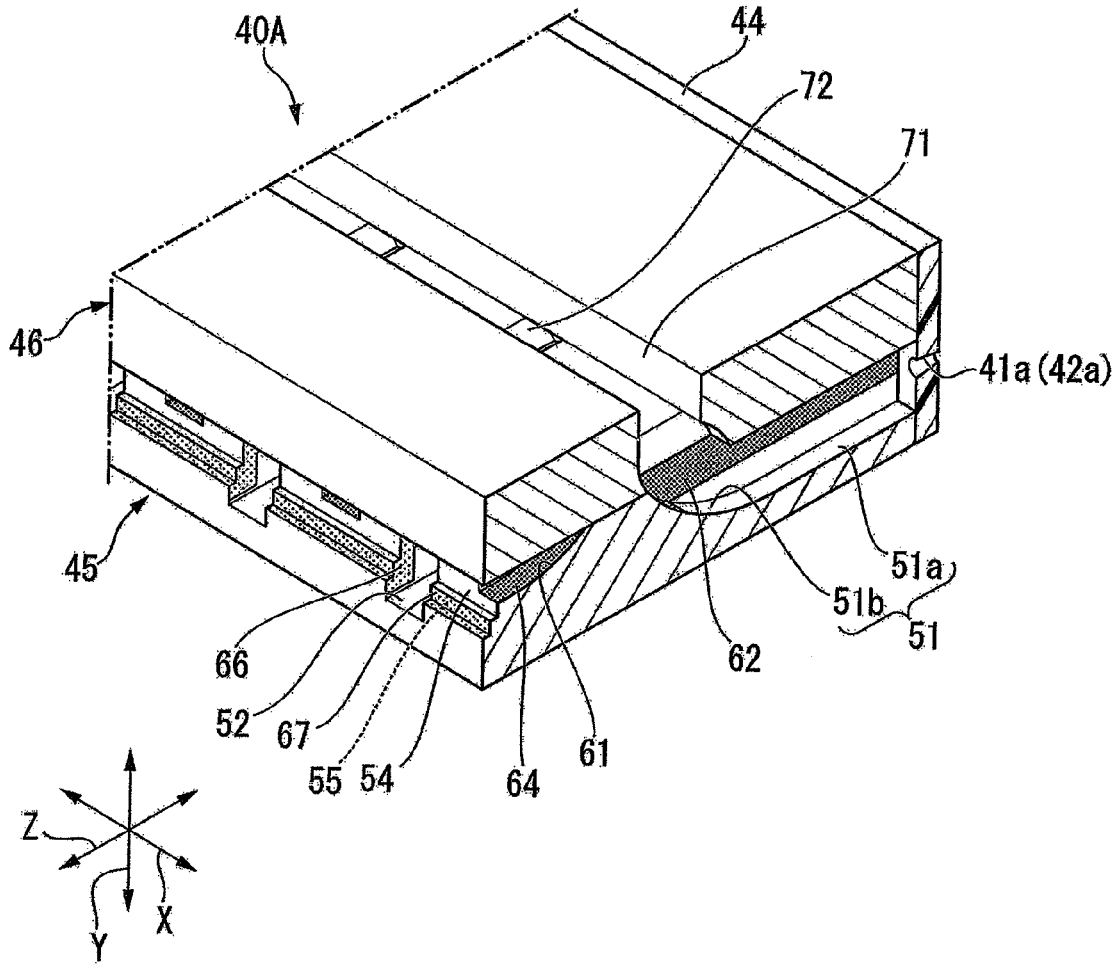
FIG. 25 is a perspective view of a discharge unit illustrating another configuration in an embodiment as viewed from one end side in the Z direction.

In the above-described embodiment, a laminate-type discharge unit 22 in which the two head chips 40A and 40B are laminated has been described. However, an example is not limited to the case. A discharge unit 22 having a single layer head chip 40A may be employed as illustrated in FIG. 25, or a laminate-type discharge unit 22 having three or more layers may be employed. Note that the number of arrays of the nozzle arrays is changed according to the number of laminated layers of the head chips.

In the above-described embodiment, an edge-shoot type inkjet head has been exemplarily described. However, an example is not limited to the case, and a side-shoot type inkjet head, which discharges an ink through a nozzle hole existing in a center of a discharge channel 51 in a longitudinal direction, may be employed.

In the above-described embodiment, a configuration to perform the oblique deposition from the direction intersecting with the X direction and the Y direction has been described. However, an example is not limited to the case, and an oblique deposition may be performed from a direction along an X direction and a Y direction.

Figure 26:
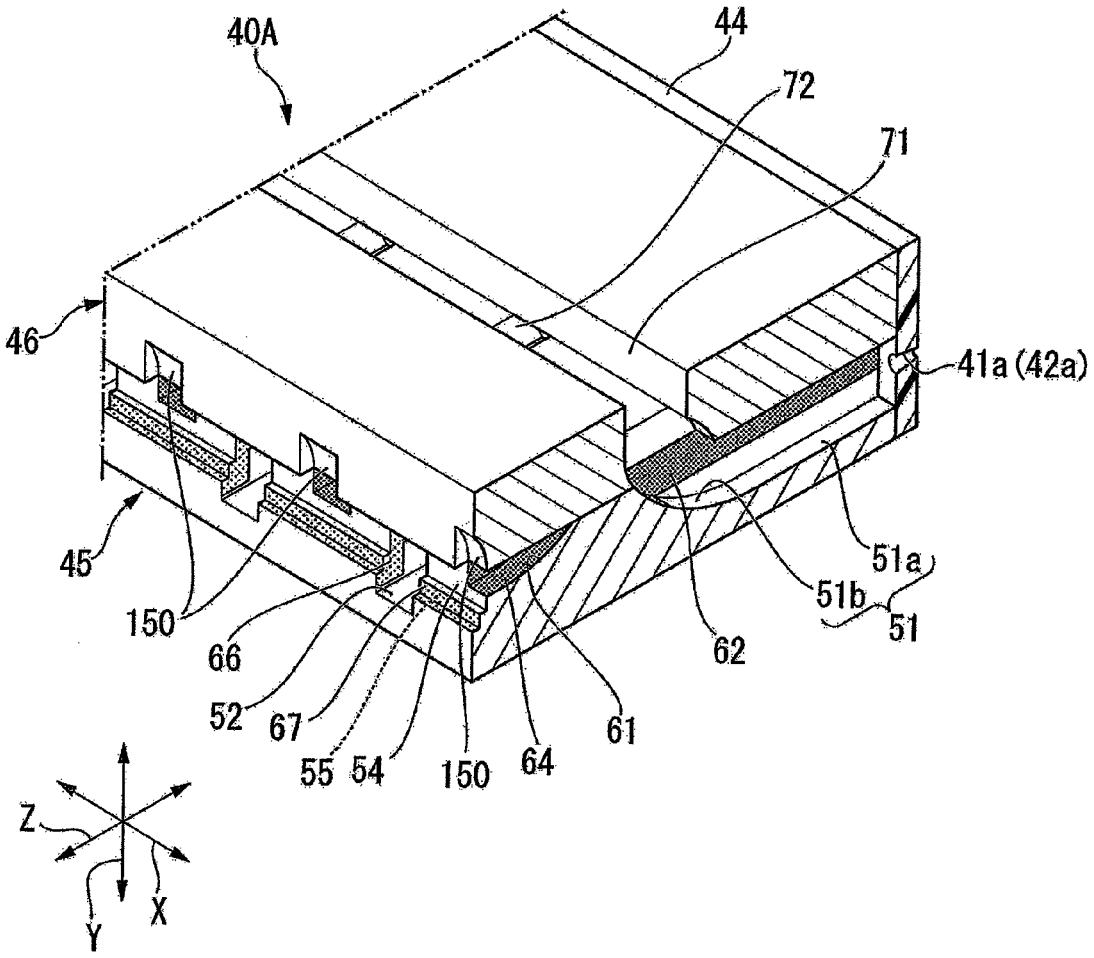
FIG. 26 is a perspective view of a discharge unit illustrating another configuration in an embodiment as viewed from one end side in the Z direction.

Further, as illustrated in FIG. 26, a counterbored portion 150 opened toward a rear side and a back side, and communicating into a shallow groove portion 61 of an actuator plate 45 may be formed in a position corresponding to the shallow groove portion 61 in an X direction, in a rear-side end portion of a cover plate 46. In this case, a bump 85 can be inserted into the shallow groove portion 61 through an opening portion defined by the shallow groove portion 61 and the counterbored portion 150 at the time of connection work of a common pad 64 and the bump 85. Accordingly, efficiency of the connection work can be achieved. Note that the counterbored portion 150 may be formed throughout the actuator plate 45 in the X direction.

In the above-described embodiment, as a recessed portion in which the common pad 64 is formed, the shallow groove portion 61 extending in the Z direction has been exemplarily described. However, an example is not limited to the case. A recessed portion may be employed as long as the recessed portion is opened toward at least the rear side of the actuator plate 45, and can accommodate the bump 85 of the FPC 33.

In the above-described embodiment, a configuration to connect the FPC 33 and the common pad 64 through the bump 85 has been described. However, an example is not limited to the case.

Figure 27:
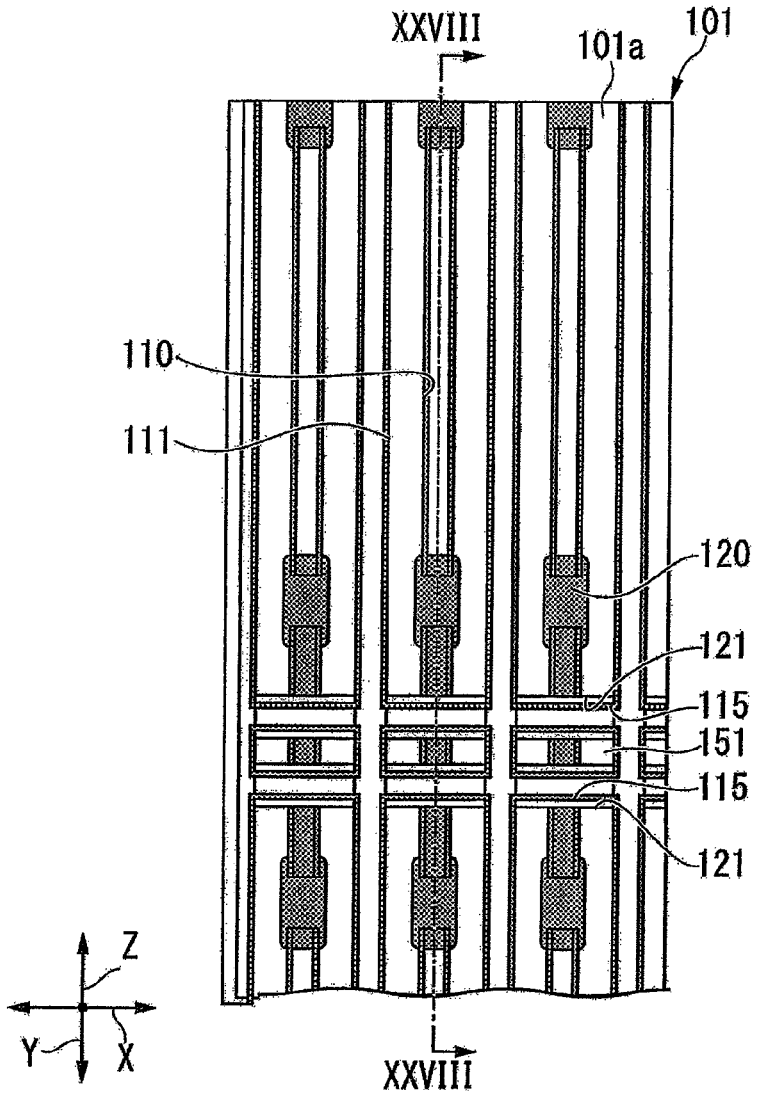
FIG. 27 is a process diagram for describing another method of an actuator wafer, manufacturing process, and is a plan view of an actuator wafer.
Figure 28:
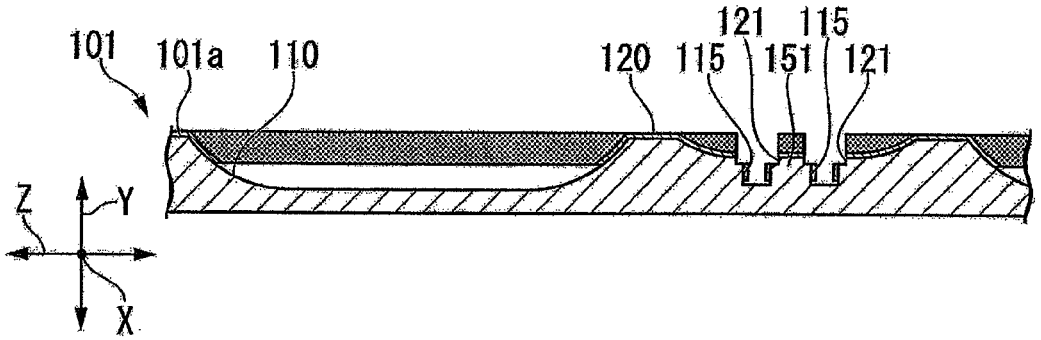
FIG. 28 is a sectional view along the XXVIII-XXVIII line of FIG. 27.

In the above-described embodiment, a configuration to form one crossing groove 115 wider than the dicing lines 110 to 112, and to cut the wafer joined body 103 at the intermediate portion of the crossing groove 115 has been described. However, an example is not limited to the configuration. For example, as illustrated in FIGS. 27 and 28, two crossing grooves 115 may be formed in an intermediate portion of a third dicing line 112 in a Z direction, of an actuator wafer 101. Then, in an individualizing process, a dicer is caused to travel to remove a partition 151 that partitions the crossing grooves 115, using a dicer wider than the partition 151. Accordingly, a connection groove 55 opened toward a rear side of the actuator wafer 101 can be formed.

According to this configuration, the groove widths of the crossing grooves 115 can be made narrower than a configuration to divide the actuator wafer 101 in one crossing groove 115. Therefore, in the electrode forming process, variation of the deposition depth due to the groove width or the groove depth of the crossing grooves 115 can be suppressed.

Figure 29:
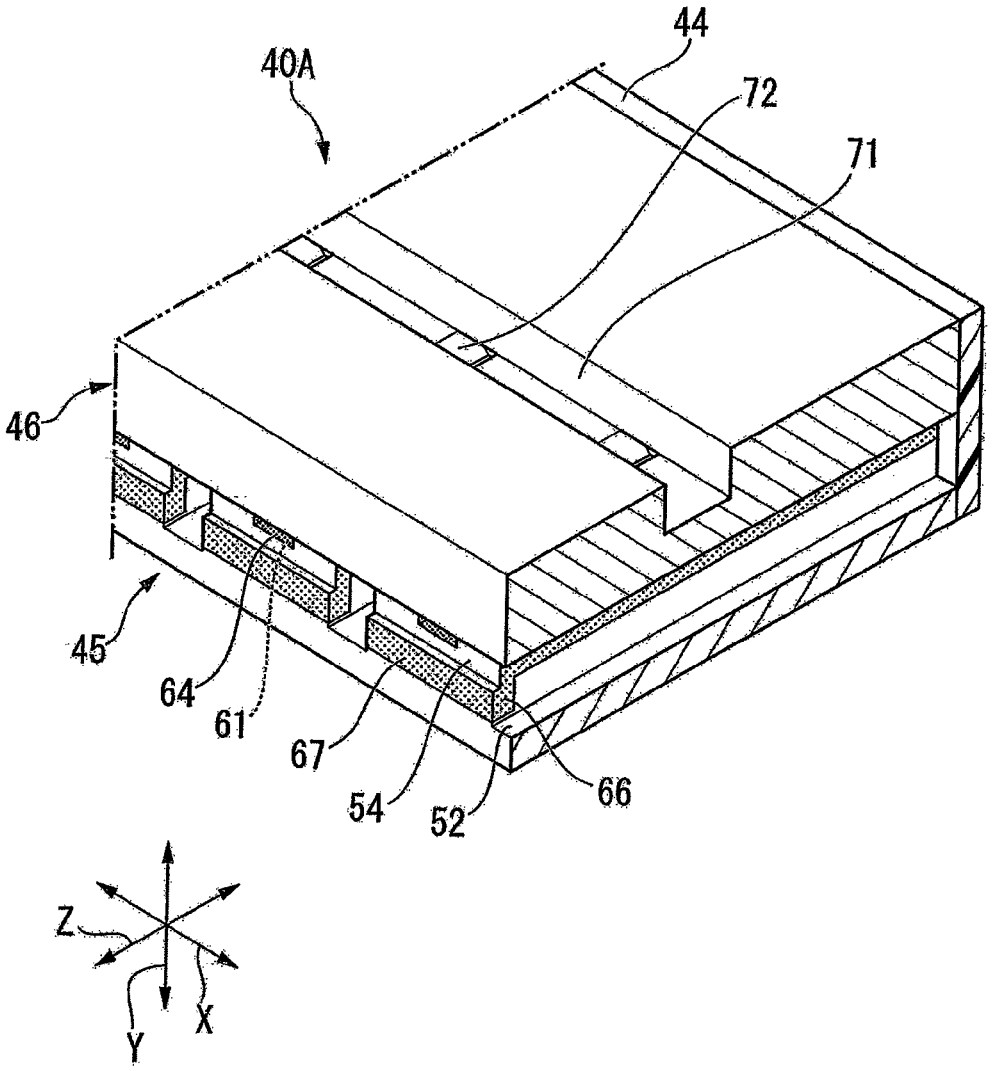
FIG. 29 is a perspective view of a discharge unit illustrating another configuration in an embodiment as viewed from one end side in the Z direction.

In the above-described embodiment, a method of collectively manufacturing the plurality of discharge units 22 from the wafer joined body 103 has been described. However, an example is not limited to the case, and the discharge units 22 may be manufactured one by one. In this case, for example, as illustrated in FIG. 29, an individual pad 67 may be directly formed on a rear-side end surface (connection surface) of an actuator plate 45 without forming the above-described connection groove 55.

In the above-described embodiment, as a dividing portion of the present invention, the dividing groove 54 has been exemplarily described. However, an example is not limited to the case, and any configuration may be employed as long as a common pad 64, and an individual electrode 66 and an individual pad 67 are divided on a surface facing a rear side, of an actuator plate 45.

In addition, the configuration elements in the above-described embodiments can be appropriately replaced with well known configuration elements without departing from the gist of the present invention, and the above-described modifications may be appropriately combined.

What is claimed is:

1. A liquid injection head comprising:

an actuator plate;

injection channels arranged in an extending manner along a first direction and arranged in parallel to a second direction intersecting with the first direction with a space in a surface of the actuator plate, and having one end portions in the first direction terminated in the actuator plate;

dummy channels arranged in an extending manner along the first direction and alternately arranged in parallel to the injection channels in the second direction in the surface of the actuator plate, and opened in one end surface of the actuate plate in the first direction;

an individual electrode formed on an inside surface of the dummy channel;

a common electrode formed on an inside surface of the injection channel;

an individual pad formed on a connection surface facing one end side in the first direction in a portion positioned between the adjacent dummy channels, the portion being of the actuator plate, individually connecting the individual electrodes opposed in the second direction across the injection channel, and to which individual-side external wiring is connected;

a recessed portion formed in a position between the adjacent dummy channels, and opened toward the one end side in the first direction, in the surface of the actuator plate;

a common pad formed in an inner surface of the recessed portion, and connecting the common electrode and common-side external wiring through the recessed portion; and a dividing portion formed in a corner portion made by the surface and the one end surface, of the actuator plate, and dividing the common pad from the individual pad.

2. The liquid injection head according to claim 1, wherein a connection groove opened toward the one end side in the first direction in the actuator plate, and depressed to the other end side in the first direction in the one end surface is formed, in the portion positioned between the adjacent dummy channels, the portion being of the actuator plate, and a surface facing the one end side in the first direction, the surface being of an inner surface of the connection groove, configures the connection surface.

3. The liquid injection head according to claim 2, wherein a groove depth of the dummy channel is deeper than a groove depth of the connection groove.

4. The liquid injection head according to claim 1, wherein a bump accommodated in the recessed portion and to be connected to the common pad in the recessed portion is formed in the common-side external wiring.

5. A method of manufacturing the liquid injection head according to claim 1, the method comprising:

a channel forming process of forming the injection channel and the dummy channel in the surface of the actuator plate;

an electrode forming process of forming an electrode material from a side of the surface of the actuator plate, the electrode material serving as the individual electrode, the individual pad, the common electrode, and the common pad; and a dividing process of forming the dividing portion in the corner portion made by the surface and the one end surface in the first direction, in the actuator plate, removing the electrode material formed on the corner portion, of the electrode material, and dividing the common pad from the individual pad.

6. The method of manufacturing the liquid injection head according to claim 5, the method comprising:

a recessed portion forming process of forming the recessed portion opened toward the one end side in the first direction in the portion positioned between the adjacent dummy channels, in the surface of the actuator plate, in a preceding part of the electrode forming process.

7. The method of manufacturing the liquid injection head according to claim 5, the method comprising:

a crossing groove forming process of forming a crossing groove extending along the second direction and intersecting with the dummy channel, in a portion positioned between the actuator plate, of a surface of a wafer to which the actuator plates continue in the first direction, in a preceding part of the electrode forming process; and an individualizing process of cutting a portion positioned between the crossing grooves and individualizing the portion for each of the actuator plates, of the wafer, in a subsequent part of the electrode forming process.

8. The method of manufacturing the liquid injection head according to claim 5, the method comprising:

a crossing groove forming process of forming two crossing grooves extending along the second direction and intersecting with the dummy channel, in the first direction with a space, in a portion positioned between the actuator plates, of a surface of a wafer in which the actuator plates continue in the first direction, in a preceding part of the electrode forming process; and an individualizing process of cutting the wafer to remove a partition positioned between the two crossing grooves, of the wafer, and individualizing the wafer for each of the actuator plates, in a subsequent part of the electrode forming process.

9. The method of manufacturing the liquid injection head according to claim 7, wherein, in the electrode forming process, oblique deposition is performed for the surface of the actuator plate from a direction intersecting with the first direction and the second direction, in plan view as the actuator plate is viewed from a thickness direction.

10. The method of manufacturing the liquid injection head according to claim 9, wherein, in the channel forming process and in the crossing groove forming process, groove widths and groove depths of the dummy channel and the crossing groove are set not to allow the electrode material to be deposited on a bottom surface of the dummy channel in the electrode forming process.

11. A liquid injection device comprising:

the liquid injection head according to claim 1; and a moving mechanism configured to relatively move the liquid injection head and a recording medium.

* * * * *